US008333382B2

(12) United States Patent
Willard et al.

(10) Patent No.: US 8,333,382 B2
(45) Date of Patent: Dec. 18, 2012

(54) FOLDABLE GAME BOARD AND SCRAP BOOK ALBUM

(75) Inventors: Heidi R. Willard, North Bethesda, MD (US); Russell J. Willard, North Bethesda, MD (US)

(73) Assignee: Scrapbooks That Teach, LLC, North Bethesda, MD (US)

( * ) Notice: Subject to any disclaimer, the term of this patent is extended or adjusted under 35 U.S.C. 154(b) by 23 days.

(21) Appl. No.: 12/328,872

(22) Filed: Dec. 5, 2008

(65) Prior Publication Data

US 2010/0140870 A1 Jun. 10, 2010

(51) Int. Cl.
*A63F 3/00* (2006.01)

(52) U.S. Cl. ..... 273/287; 270/285; 270/286

(58) Field of Classification Search ..... 273/285, 273/286, 287; D21/335, 341, 342
See application file for complete search history.

(56) References Cited

U.S. PATENT DOCUMENTS

| | | | | | |
|---|---|---|---|---|---|
| 378,931 | A | * | 3/1888 | Hyde | 273/261 |
| 415,371 | A | | 11/1889 | Smith | |
| 2,108,527 | A | * | 2/1938 | Cudmore | 273/148 A |
| 2,147,900 | A | * | 2/1939 | Houseknecht | 273/285 |
| 2,722,425 | A | * | 11/1955 | Gazelle | 273/142 R |
| 3,346,259 | A | * | 10/1967 | Froehlig | 273/285 |
| 4,261,576 | A | * | 4/1981 | Friedenthal | 273/285 |
| 4,616,832 | A | * | 10/1986 | Groner | 273/238 |
| 5,280,914 | A | | 1/1994 | Selby et al. | |
| 5,478,086 | A | | 12/1995 | Aylett | |
| D450,779 | S | * | 11/2001 | Ko | D21/335 |
| 6,925,739 | B1 | | 8/2005 | Cole et al. | |
| 7,568,702 | B2 | * | 8/2009 | Holden et al. | 273/285 |
| 2004/0026857 | A1 | | 2/2004 | O'Connell | |
| 2006/0273511 | A1 | | 12/2006 | Rosenquist | |
| 2007/0057463 | A1 | * | 3/2007 | Del Rincon | 273/285 |
| 2007/0102919 | A1 | | 5/2007 | Karchmer | |
| 2008/0128988 | A1 | | 6/2008 | Mullen | |

OTHER PUBLICATIONS

Moses, A. "Academic Scrapbooking: Snapshots of Learning." [online] Edutopia.org, Aug. 29, 2007 [retrieved on Nov. 6, 2008] Retrieved from the Internet: <URL: http://www.edutopia.org/print/4662 ; 3 pages.

Photo-opoly Board Game, Late for the Sky Production Company. Product Information [online] Barnes & Noble [retrieved on Nov. 10, 2008] Retrieved from the Internet: <URL: http://gifts.barnesandnoble.com/Toys-games/Photo-opoly-Board-Game/e/9781932150506; 1 page.

* cited by examiner

*Primary Examiner* — Vishu K. Mendiratta
(74) *Attorney, Agent, or Firm* — Cooley LLP

(57) ABSTRACT

A game board has a first side and a second side. The first side of the game board includes a plurality of markings associated with a game. The markings can be associated with a particular tourist destination, such as, for example, a national park. The game board is configured to fold such that the game board is moveable between an expanded configuration and a collapsed configuration. When the game board is in its expanded configuration, the game board is substantially planar. When the game board is in its collapsed configuration, at least a portion of the game board is folded to form at least one pocket adjacent the second side of the game board. The pocket is configured to receive at least a portion of an object, such as, for example, a picture and/or other memorabilia.

15 Claims, 24 Drawing Sheets

FOLDABLE GAME BOARD AND SCRAP BOOK ALBUM

BACKGROUND

This invention relates to a game board, and more particularly, to a foldable game board configured to be converted into a memorabilia display device, scrap book and/or photo album.

Some known board games include markings and/or information designed to educate the players while also allowing opposing players to compete against each other. Such markings and/or information can include, for example, information associated with the geography, history, and/or other details related to a particular place of interest. For example, some known board games include markings and/or information associated with a tourist destination. Such known board games, however, do not allow the players to include information, memorabilia and/or objects associated with their experience while visiting a tourist destination.

Thus, a need exists for a board game that can be customized with objects, such as, for example, pictures or other memorabilia, associated with a player's experience with the topic of the game.

SUMMARY

Foldable game boards and methods of converting game boards into a memorabilia display device (e.g., a scrap book page, a photo album or the like) are described herein. In some embodiments, a game board has a first side and a second side. The first side of the game board includes a plurality of markings associated with a game. The markings can be associated with a particular tourist destination, such as, for example, a national park. The game board is configured to fold such that the game board is moveable between an expanded configuration and a collapsed configuration. When the game board is in its expanded configuration, the game board is substantially planar. When the game board is in its collapsed configuration, at least a portion of the game board is folded to form at least one pocket adjacent the second side of the game board. The pocket is configured to receive at least a portion of an object, such as, for example, a picture and/or other memorabilia.

DETAILED DESCRIPTION

Figure 1:
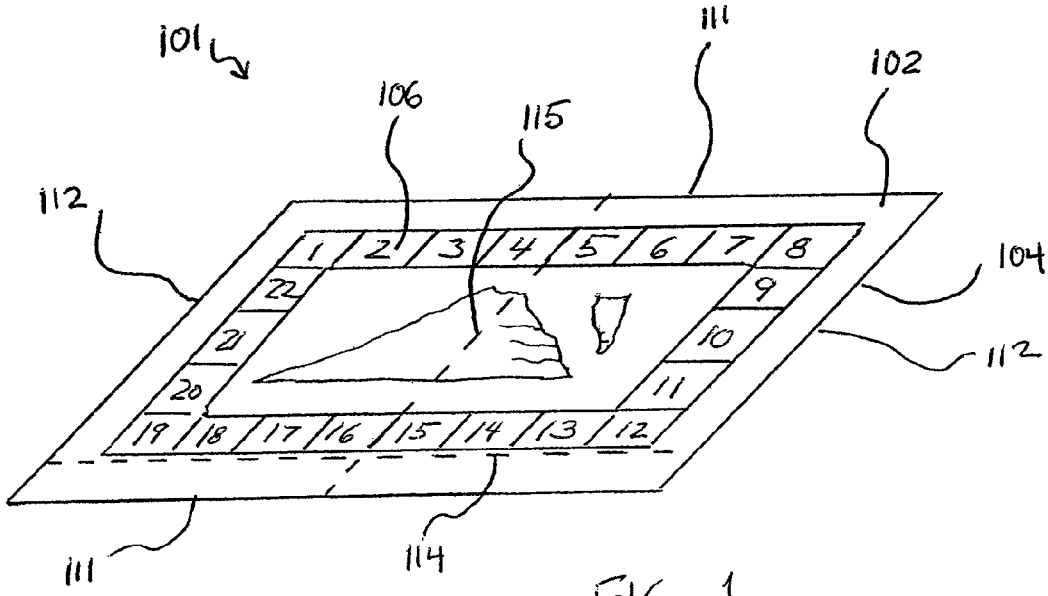
FIGS. 1-3 are perspective views of a game board according to an embodiment, in a first configuration, a second configuration and a third configuration, respectively.

Foldable game boards and methods of converting game boards into a memorabilia display device (e.g., a scrap book page, a photo album or the like) are described herein. In some embodiments, a game board has a first side and a second side. The first side of the game board includes multiple markings, such as, for example, spaces, patterns or the like, associated with a game. The markings can be associated with a particular tourist destination, such as, for example, a national park. The game board is configured to fold such that the game board is moveable between an expanded configuration and a collapsed configuration. When the game board is in its expanded configuration, the game board is substantially planar. When the game board is in its collapsed configuration, at least a portion of the game board is folded to form at least one pocket adjacent the second side of the game board. The pocket is configured to receive at least a portion of an object, such as, for example, a picture and/or other memorabilia.

In some embodiments, a game board has a first side and a second side. The first side includes multiple markings associated with a game. The game board has an expanded configuration and a collapsed configuration. The first side of the game board is substantially planar when the game board is in its expanded configuration. The game board is configured to be folded to form a plurality of pages when the game board is in its collapsed configuration. Each page from the plurality of pages is configured to receive a portion of an object. The object can be, for example, a picture and/or other memorabilia associated with a player of the game.

In some embodiments, a game board is configured to be folded between an expanded configuration and a collapsed configuration. The game board has a first side and a second side. The first side of the game board including a set of markings associated with a game. The markings can be associated with a particular tourist destination, such as, for example, a national park. The set of markings includes at least one outline associated with a space for a game piece. The game board includes a perforated portion within the outline. The perforated portion is configured to be separated from the game board to form a retention portion (e.g., a retention flap). The retention portion is configured to removably retain an object against the second side of the game board when the game board is in its collapsed configuration.

The term "parallel" is used herein to describe a relationship between two geometric constructions (e.g., two lines, two planes, a line and a plane, two curved surfaces, a line and a curved surface or the like) in which the two geometric constructions are substantially non-intersecting as they extend substantially to infinity. For example, as used herein, a planar surface (i.e., a two-dimensional surface) is said to be parallel to a line when every point along the line is spaced apart from the nearest portion of the surface by a substantially equal distance. Similarly, as used herein, a fold line is said to be parallel to an edge of a surface when every point along the line is spaced apart from the nearest portion of the edge of the surface by a substantially equal distance. Two geometric constructions are described herein as being "parallel" or "substantially parallel" to each other when they are nominally parallel to each other, such as for example, when they are parallel to each other within a tolerance. Such tolerances can include, for example, manufacturing tolerances, measurement tolerances or the like.

The terms "perpendicular," "orthogonal," and/or "normal" are used herein to describe a relationship between two geometric constructions (e.g., two lines, two planes, a line and a plane, two curved surfaces, a line and a curved surface or the like) in which the two geometric constructions intersect at an angle of approximately 90 degrees within at least one plane. For example, as used herein, a line is said to be normal to a planar surface when the line and the planar surface intersect at an angle of approximately 90 degrees within a plane. Similarly, a fold line is said to be normal to an edge of a surface when the fold line and the edge of the surface intersect an angle of approximately 90 degrees. Two geometric constructions are described herein as being "orthogonal" or "substantially orthogonal" to each other when they are nominally orthogonal to each other, such as for example, when they are orthogonal to each other within a tolerance. Such tolerances can include, for example, manufacturing tolerances, measurement tolerances or the like.

It should be understood that the references to geometric constructions are for purposes of discussion and illustration. The actual structures may differ from geometric ideal due to tolerances and/or other minor deviations from the geometric ideal.

Figure 2:
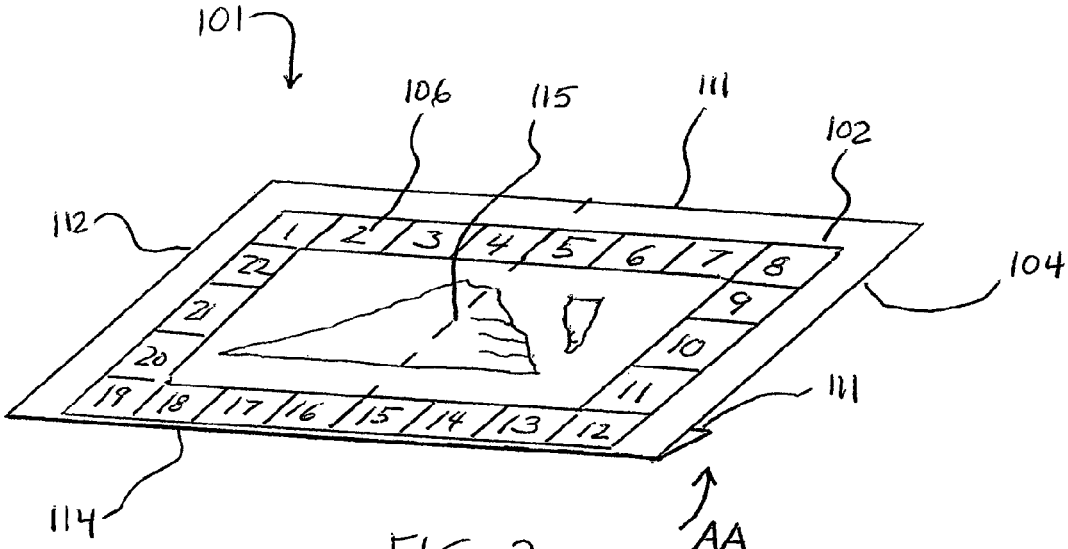
Figure 3:
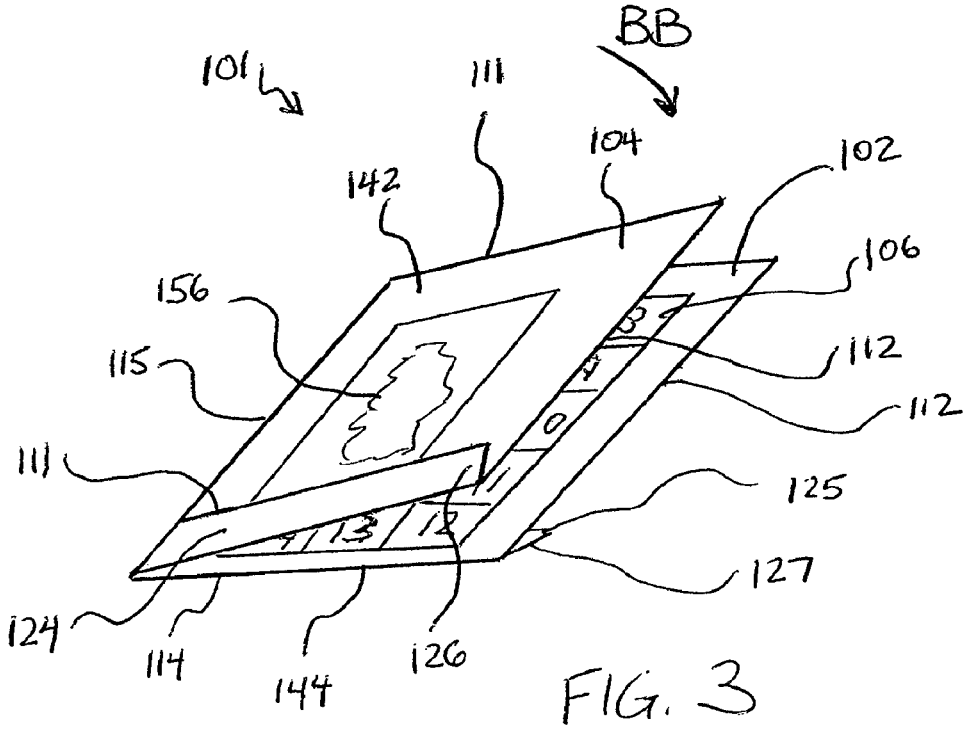

FIGS. 1-3 are perspective views of a game board 101 according to an embodiment, in a first configuration, a second configuration and a third configuration, respectively. As described herein, the game board 101 can be used to play a game, such as, for example, a trivia game, a strategic game, a game of chance or the like, associated with a particular game topic. The game topic can include any suitable game topic, such as, for example, a tourist destination, a geographical region, a historical topic or the like. In some embodiments, for example, the game topic can be associated with a park or landmark. More particularly, in some embodiments, the game topic can be associated with the landmarks, preservation, history, governmental action, geology, archaeology and/or the like associated with a national park.

The game board 101 has a first side 102 and a second side 104. The first side 102 includes a set of markings 106 associated with the game. The markings 106 can include any suitable markings associated with the game, such as, for example, spaces upon which a game piece (not shown) can be placed, directions for playing the game and/or the like. As shown in FIG. 1, when the game board 101 is in the first configuration, the game board 101 is substantially planar. More particularly, when the game board 101 is in the first configuration, the lateral edges 112 of the game board 101 and the longitudinal edges 111 of the game board 101 define a substantially rectangular, flat playing surface. In this manner, when the game board 101 is in the first configuration, one or more players can use the first side 102 of the game board 101 to play the game.

As shown, the game board 101 can be moved between the first configuration, the second configuration and/or the third configuration by folding one or more portions of the game board 101. More particularly, the game board 101 includes a first fold line 114 and a second fold line 115, each of which are shown as dashed lines in FIG. 1. The first fold line 114 is substantially parallel to the longitudinal edges 111 of the game board 101, and the second fold line 115 is substantially parallel to the lateral edges 112 of the game board 101. Similarly stated, the first fold line 114 is substantially normal to the second fold line 115. In other embodiments, however, the first fold line 114 can be non-parallel to and/or non-normal to the longitudinal edges 111 of the game board 101 and/or the lateral edges 112 of the game board 101. Similarly, in other embodiments, the second fold line 115 can be non-parallel to and/or non-normal to the longitudinal edges 111 of the game board 101 and/or the lateral edges 112 of the game board 101.

The first fold line 114 and the second fold line 115 are configured to assist a player (or user) in moving the game board between the first configuration, the second configuration and the third configuration. In this manner, the game board 101 is configured to be folded in a predetermined manner and/or sequence when moved between an expanded configuration (e.g., the first configuration, as shown in FIG. 1) and a collapsed configuration (e.g., the third configuration, as shown in FIG. 3). In some embodiments, the first fold line 114 and/or the second fold line 115 can include markings to assist the user in folding the game board 101. In other embodiments, the first fold line 114 and/or the second fold line 115 can include a crease, perforations, a seam and/or a pre-stressed portion configured to assist the user in folding the game board 101. In some embodiments, for example, the first fold line 114 and/or the second fold line 115 can include a crease such that the user can easily fold a portion of the game board 101 about the first fold line 114 and/or the second fold line 115 in a first direction while inhibiting the user from folding the portion of the game board 101 about the first fold line 114 and/or the second fold line 115 in a second direction.

The game board 101 can be moved from the first configuration to the second configuration by folding a portion of the game board 101 along the first fold line 114 as shown by the arrow AA in FIG. 2. More particularly, the portion of the game board 101 adjacent the longitudinal edge 111 is folded about the first fold line 114 such that the longitudinal edge 111 is adjacent the second side 104 of the game board 101. Similarly stated, the game board 101 can be moved from the first configuration to the second configuration by folding the portion of the game board 101 adjacent the longitudinal edge 111 away from (i.e., in a direction opposite of) the first side 102 of the game board.

The size of the portion of the game board 101 folded to move the game board 101 from the first configuration to the second configuration can be any suitable amount. For example, in some embodiments, the portion of the game board 101 folded about the first fold line 114 can be substantially less than the overall width of the game board 101. For example, in some embodiments, the game board can have an overall width (i.e., a width when the game board 101 is in the first configuration) of approximately 12 inches, and the portion of the game board 101 folded about the first fold line 114 can have a width of approximately ½ inch. In other embodiments, the game board can have an overall width of between approximately 8 inches and 20 inches, and the portion of the game board 101 folded about the first fold line 114 can have a width of between approximately ¼ inch and 1 inch. In yet other embodiments, the game board can have an overall width of between approximately 8 inches and 20 inches, and the portion of the game board 101 folded about the first fold line 114 can have a width of between approximately 1 inch and 2 inches.

The game board 101 can be moved from the second configuration to the third configuration by folding the game board 101 along the second fold line 115 as shown by the arrow BB in FIG. 3. More particularly, the game board 101 is folded substantially in half about the second fold line 115 such that the lateral edges 112 are adjacent each other. In this manner, the game board 101 is folded into a first portion 142 and a second portion 144. As shown in FIG. 3, the game board 101 is folded substantially in half about the second fold line 115 such that the second side 104 of the game board 101 is exposed. Similarly stated, the game board 101 is folded substantially in half about the second fold line 115 inward towards the first side 102 of the game board.

When the game board 101 is in the third configuration, the second side 104 of the game board 101 includes a first pocket 124 and a second pocket 125. Similarly stated, when the game board 101 is in the third configuration, the first portion 142 of the game board 101 includes the first pocket 124 adjacent the second side 104 of the game board 101. When the game board 101 is in the third configuration, the second portion 144 of the game board 101 includes the second pocket 125 adjacent the second side 104 of the game board 101. The first pocket 124 and/or the second pocket 125 are configured to receive at least a portion of an object 156. In this manner, the game board 101 can be converted from a substantially planar surface associated with the game to a folded surface configured to contain memorabilia (e.g., the object 156). Similarly stated, in this manner, the game board 101 can be converted from a substantially planar surface associated with the game to a display device (e.g., a scrapbook page, a desk display or the like) configured to contain memorabilia. When the game board 101 is in the third configuration, the game board 101 can be placed on a surface (e.g., a desk, table or the like) on the edge formed by the first fold line 114. Similarly stated, when the game board 101 is in the third configuration, the game board 101 is a self-standing display device.

The first pocket 124 includes an open-ended portion 126. Similarly, the second pocket 125 includes an open-ended portion 127. The open-ended portions 126, 127 can provide a passageway through which the object 156 can be placed into the pockets 124, 125. In some embodiments, the second side 104 of the game board 101 can include an adhesive portion (not shown in FIGS. 1-3) such that the open-ended portions 126, 127 can be closed after the object 156 is disposed within the pockets 124, 125. Such an adhesive portion can include any suitable adhesive (e.g., self-adhesive, adhesive requiring moisture to activate or the like). In other embodiments, the open-ended portions 126, 127 can be closed when the game board 101 is in the third configuration by any suitable mechanism, such as, for example, a pin, a staple, a clip or the like.

The object 156 can be any suitable object or memorabilia associated with the players. For example, in some embodiments, the object 156 can be a ticket stub, an entry pass, a photograph or the like. In some embodiment, the object 156 can be associated with the game topic. For example, in some embodiments, the game topic can be related to a national park and the object 156 can be a photograph of the players taken while visiting the national park. In this manner, the game board 156 can provide educational entertainment for players while visiting the national park, as well as provide a device for displaying memorabilia associated with the player's visit to the national park.

Although the game board 101 is shown and described as being foldable into two portions (e.g., the first portion 142 and the second portion 144), in other embodiments, a game board can be folded into any number of different portions. For example, FIGS. 4-12 show a game kit 200 according to an embodiment. The game kit includes a game board 201, a set of game pieces 250 and a storage tube 254.

Figure 4:
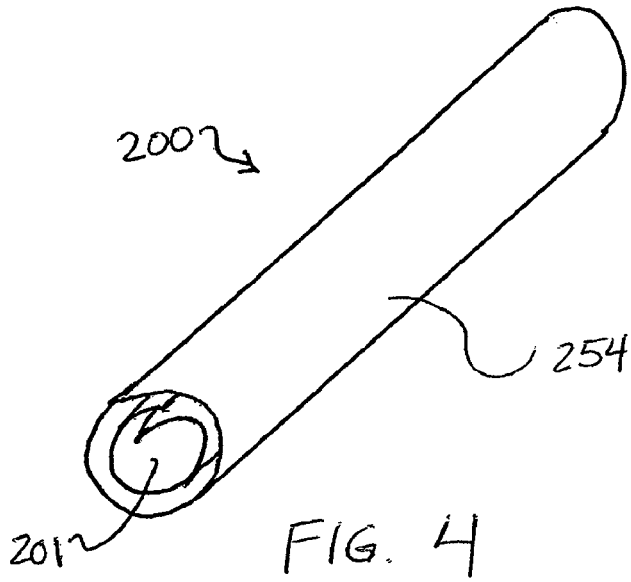
FIG. 4 is a perspective view of a game kit according to an embodiment.

The game board 201 can be used to play a game associated with a game topic. The game can be any game of the types shown and described herein. The game topic can include any suitable game topic of the types shown and described herein. In some embodiments, the game topic can be associated with the landmarks, preservation, history, governmental action, geology, archaeology and/or the like associated with a national park. As shown in FIG. 4, the game board 201 can be rolled into a substantially cylindrical shape for storage within the storage tube 254. Although the game board 201 is shown as being rolled for storage purposes, in other embodiments at least a portion of the game board 201 can be folded for storage within the storage tube 254.

The game pieces 250 (see e.g., FIG. 5) can be any suitable pieces, markers, dice or the like associated with the game and/or the game topic. As described in more detail herein, the game pieces 250 are configured to secure a portion of the game board 201 when the game board 201 is in a folded configuration (see e.g., FIGS. 10-12). In some embodiments, the game pieces can include a pin (e.g., a lapel pin, a decorative pin, or the like) associated with the game and/or the game topic. For example, in some embodiments, the game topic can be associated with a particular national park and the game pieces can include a pin or marker bearing an insignia or emblem associated with the particular national park. Although not shown in FIG. 4, the game pieces 250 can be stored within the storage tube 254.

The game board 201 has a first surface 202 and a second surface 204. The first surface 202 includes a set of markings 206 associated with the game and/or the game topic. The markings 206 include spaces and/or outlines 208 upon which a game piece 250 can be placed when the game is being played. The markings 206 also include a first set of indicia 207 adjacent a first longitudinal edge 211 of the game board 201 and a second set of indicia 207' adjacent a second longitudinal edge 211' of the game board 201. The indicia 207, 207' can be any suitable indicia associated with the game, the game topic and/or the players of the game. In some embodiments, the indicia 207, 207' can include, for example, directions for playing the game, a logo or insignia associated with a place of interest (e.g., a national park), a place for the players to personalize the game board 201 (e.g., by writing in their names, the date, or the like), or the like. As described in more detail herein, when the game board 201 is folded into a collapsed configuration (see e.g., FIGS. 8, 10 and 12) the indicia 207, 207' are adjacent the second surface 204 of the game board 201. Similarly stated, when the game board 201 is folded into a collapsed configuration, the portion of the game board 201 including the indicia 207, 207' is folded against the second surface 204 of the game board 201 such that the indicia 207, 207' are exposed and/or displayed with the second surface 204 of the game board 201. Said another way, when the game board 201 is folded into a collapsed configuration, the indicia 207, 207' are displayed when viewed in a direction towards the second surface, as shown by the arrow V' in FIG. 6.

Figure 5:
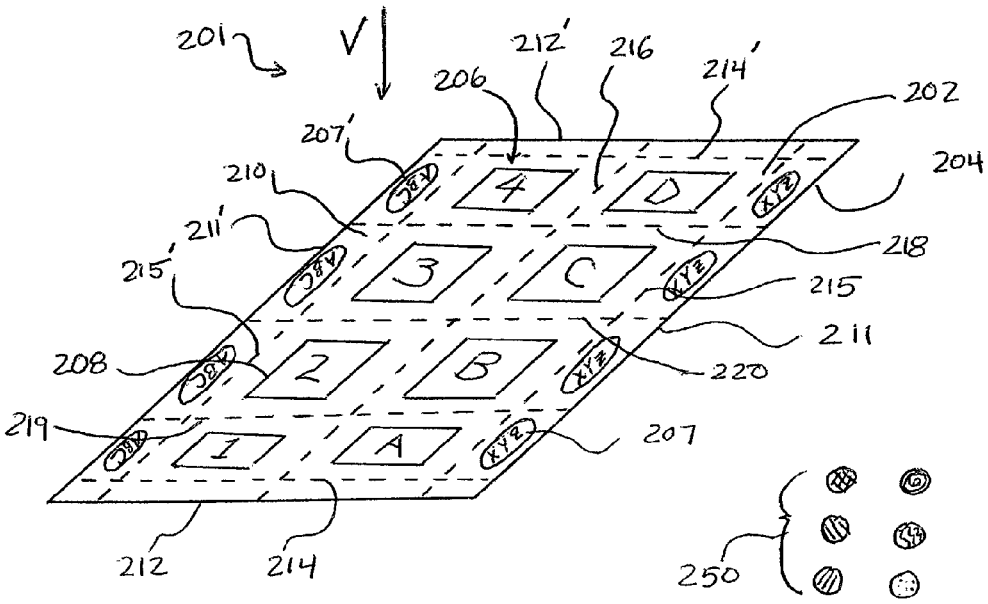
FIG. 5 is a perspective view of a game board and a set of game pieces of the game kit shown in FIG. 4 in a first configuration.

As shown in FIG. 5, when the game board 201 is in the first configuration, the game board 201 is substantially planar. More particularly, when the game board 201 is in the first configuration, a first lateral edge 212, a second lateral edge 212', a first longitudinal edge 211 and a second longitudinal edge 211' collectively define a substantially rectangular, flat playing surface. In this manner, when the game board 201 is in the first configuration, one or more players can use the first side 202 of the game board 201 to play the game. Similarly stated, when the game board 201 is in the first configuration, the markings 206, outlines 208, first set of indicia 207 and second set of indicia 207' are exposed and/or displayed with the first surface 202 of the game board 201. Said another way, when the game board 201 is in the first configuration, the indicia 207, 207' are displayed when viewed in a direction towards the first surface, as shown by the arrow V in FIG. 5.

As shown, the game board 201 can be moved between the first configuration and several different collapsed configurations by folding one or more portions of the game board 201. More particularly, the game board 201 includes a first lateral fold line 214 and a second lateral fold line 214', each of which are shown as dashed lines in FIGS. 5 and 6. The first lateral fold line 214 is substantially parallel to the first lateral edge 212. The second lateral fold line 214' is substantially parallel to the second lateral edge 212'. The game board 201 also includes a first longitudinal fold line 215 and a second longitudinal fold line 215', each of which are shown as dashed lines in FIG. 5. The first longitudinal fold line 215 is substantially parallel to the first longitudinal edge 211. The second longitudinal fold line 215' is substantially parallel to the second longitudinal edge 211'. Similarly stated, the first longitudinal fold line 215 and the second longitudinal fold line 215' are substantially normal to the first lateral fold line 214 and the second lateral fold line 214'.

The first lateral fold line 214, the second lateral fold line 214', the first longitudinal fold line 215 and the second longitudinal fold line 215' collectively define a perimeter portion 210 of the game board 201. Similarly stated, the perimeter portion 210 of the game board 201 includes the area between the first lateral edge 212 and the first lateral fold line 214, the area between the second lateral edge 212' and the second lateral fold line 214', the area between the first longitudinal edge 211 and the first longitudinal fold line 215, and the area between the second longitudinal edge 211' and the second longitudinal fold line 215'. The first set of indicia 207 and second set of indicia 207' are disposed within the perimeter portion 210 of the game board.

The perimeter portion 210 can have any suitable size (i.e., width). For example, in some embodiments, the perimeter portion 210 can have a width of approximately ½ inch. In other embodiments, the perimeter portion 210 can have a width of between approximately ¼ inch and 1 inch. In yet other embodiments, the perimeter portion 210 can have a width of between approximately 1 inch and 2 inches. Moreover, although the width of the perimeter portion 210 is shown as being substantially uniform, in other embodiments, the width of the perimeter portion 210 can be non-uniform. Similarly stated, in some embodiments, the width of the perimeter portion 210 between the first lateral edge 212 and the first lateral fold line 214 and be different from the width of the perimeter portion 210 between the second lateral edge 212' and the second lateral fold line 214', the width of the perimeter portion 210 between the first longitudinal edge 211 and the first longitudinal fold line 215, and/or the width of the perimeter portion 210 between the second longitudinal edge 211' and the second longitudinal fold line 215'.

The game board 201 includes a third lateral fold line 218, a fourth lateral fold line 219 and a central lateral fold line 220, each of which are shown as dashed lines in FIGS. 5-9. The game board 201 also includes a central longitudinal fold line 216, shown as a dashed line in FIGS. 5-7. The third lateral fold line 218 and the fourth lateral fold line 219 are substantially parallel to each other and substantially parallel to the lateral edges 212, 212'. The central lateral fold line 218 substantially bisects the game board 201, and is substantially parallel to the lateral edges 212, 212'. The central longitudinal fold line 216, substantially bisects the game board 201, and is substantially parallel to the longitudinal edges 211, 211'. Similarly stated, the central longitudinal fold line 216 is substantially normal to the lateral edges 212, 212'.

Each of the fold lines described above with respect to the game board 201 is configured to assist the user in moving the game board 201 between the various folded configurations, as described in more detail herein. In this manner, the game board 201 is configured to be folded in a predetermined manner and/or sequence when moved between the various folded configurations. In some embodiments, any of the fold lines described above can include markings to assist the user in folding the game board 201. In other embodiments, any of the fold lines described above can include a crease, perforations, a seam and/or a pre-stressed portion configured to assist the user in folding the game board 201. In some embodiments, for example, the central longitudinal fold line 216 and/or the central lateral fold line 220 can include a crease such that the user can easily fold a portion of the game board 201 about the central longitudinal fold line 216 and/or the central lateral fold line 220 in a first direction while inhibiting the user from folding the portion of the game board 201 about the central longitudinal fold line 216 and/or the central lateral fold line 220 in a second direction.

Figure 6:
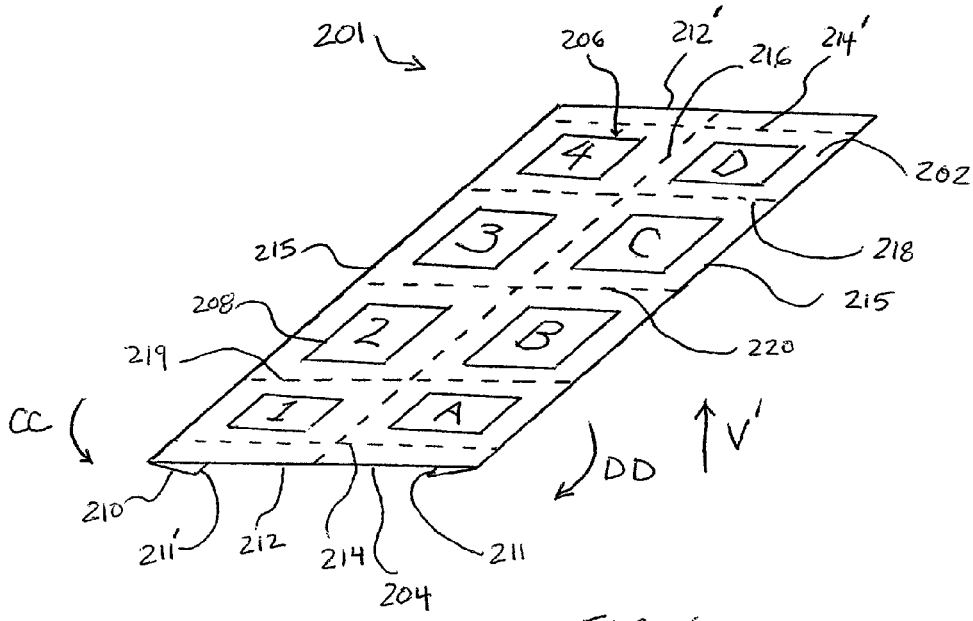
FIGS. 6-8 are perspective views of the game board shown in FIG. 5 in a first folded configuration, a second folded configuration and a third folded configuration, respectively.

The game board 201 can be moved from the first configuration to the second configuration by folding a first portion of the perimeter portion 210 of the game board 201 along the first longitudinal fold line 215 and a second portion of the perimeter portion 210 along the second longitudinal fold line 215' as shown by the arrows CC and DD in FIG. 6. More particularly, the first portion and the second portion of the perimeter portion 210 are folded about the first longitudinal fold line 215 and the second longitudinal fold line 215', respectively, such that the first longitudinal edge 211 and the second longitudinal edge 211' are each disposed against the second surface 204 of the game board 201. Similarly stated, the first portion and the second portion of the perimeter portion 210 are folded about the first longitudinal fold line 215 and the second longitudinal fold line 215', respectively, away from the first surface 202 of the game board 201. When the game board 201 is in the second configuration (FIG. 6), the first set of indicia 207 and the second set of indicia 207' are exposed and/or displayed with the first surface 202 of the game board 201. Said another way, when the game board 201 is in the second configuration, the indicia 207, 207' are displayed when viewed in a direction towards the second surface 204, as shown by the arrow V' in FIG. 6. Similarly stated, when the game board 201 is in the second configuration, the first set of indicia 207 and the second set of indicia 207' are on an opposite side of the game board 201 from the markings 206 and outlines 208.

Figure 7:
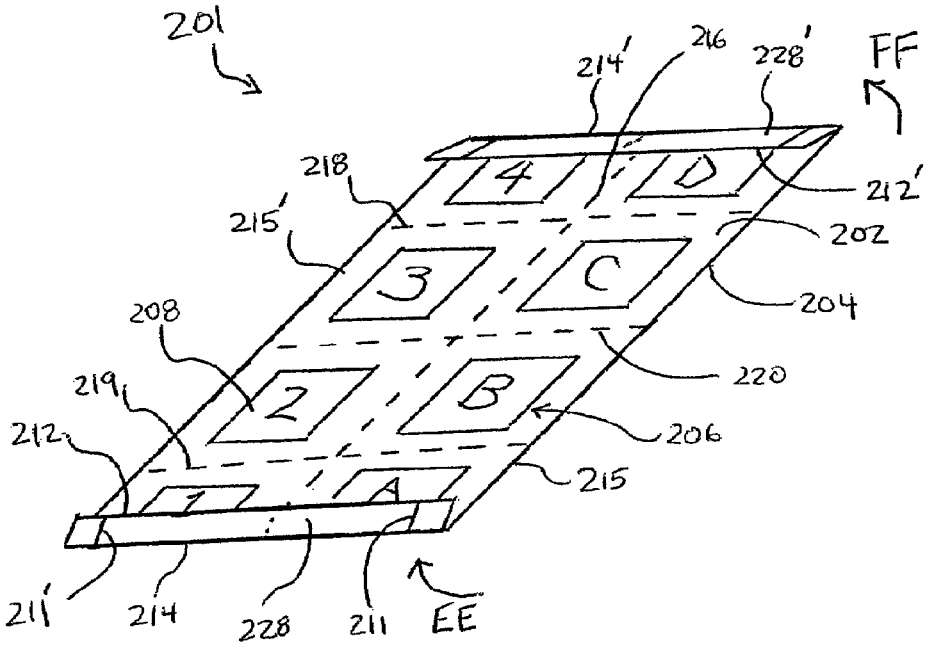

The game board 201 can be moved from the second configuration to the third configuration by folding a third portion of the perimeter portion 210 of the game board 201 along the first lateral fold line 214 and a fourth portion of the perimeter portion 210 along the second lateral fold line 214' as shown by the arrows EE and FF in FIG. 7. More particularly, the third portion and the fourth portion of the perimeter portion 210 are folded about the first lateral fold line 214 and the second lateral fold line 214', respectively, such that the first lateral edge 212 and the second lateral edge 212' are each disposed against the first surface 202 of the game board 201. Similarly stated, the third portion and the fourth portion of the perimeter portion 210 are folded about the first lateral fold line 214 and the second lateral fold line 214', respectively, towards from the first surface 202 of the game board 201. When the game board 201 is in the third configuration (FIG. 7), the third portion and the fourth portion of the perimeter portion 210 form cuff folds 228, 228'. As described in more detail herein, the cuff folds 228, 228' can be used to stiffen the edges of the game board 201 when the game board 201 is in a collapsed configuration (see e.g., FIG. 10).

Figure 8:
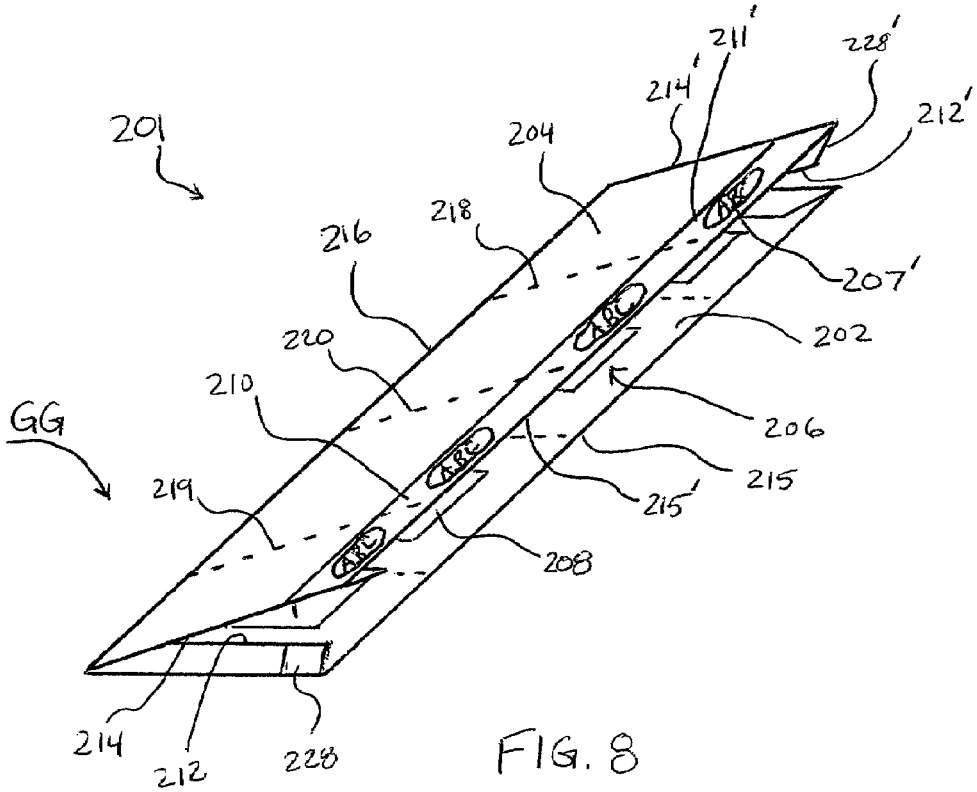
Figure 9:
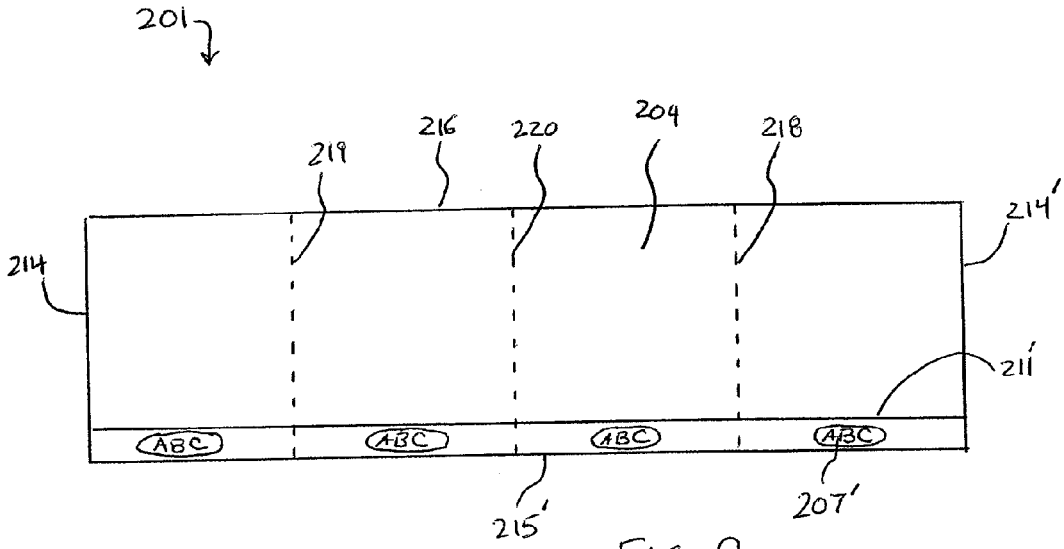
FIG. 9 is a top view of the game board shown in FIG. 8 in the third folded configuration.

The game board 201 can be moved from the third configuration to the fourth configuration by folding the game board 201 along the central longitudinal fold line 216, as shown by the arrow GG in FIG. 8. Similarly stated, the game board 201 is folded about the central longitudinal fold line 216 towards the first surface 202 of the game board 201. As shown in FIG. 8, the game board 201 is folded substantially in half about the central longitudinal fold line 216 such that the first longitudinal fold line 215 is adjacent and/or in contact with the second longitudinal fold line 215'. In this manner, the first longitudinal fold line 215 and the second longitudinal fold line 215' collectively form an edge of the game board 201 opposite the central longitudinal fold line 216. When the game board 201 is in the fourth configuration, the second surface 204 of the game board 201 is displayed and/or exposed. Said another way, when the game board 201 is in the fourth configuration, the first surface 202 of the game board 201 is disposed between the two folded portions of the second surface 204 of the game board 201. As shown in FIGS. 8 and 9, when the game board 201 is in the fourth configuration, the indicia 207, 207' are exposed and/or displayed.

Figure 10:
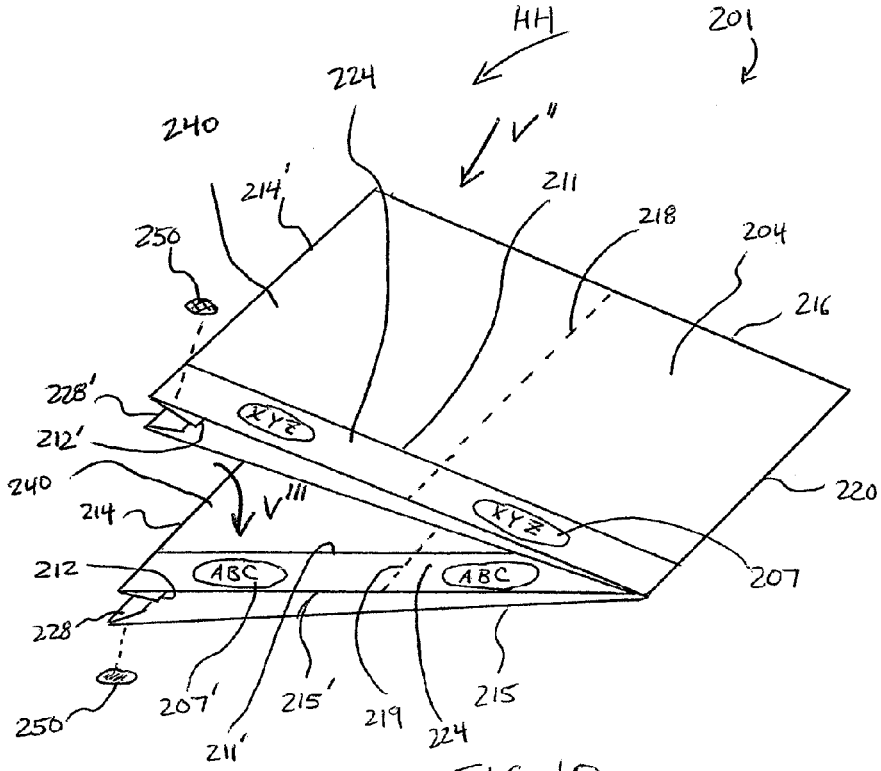
FIGS. 10-12 are perspective views of the game board shown in FIG. 5 in a fourth folded configuration, a fifth folded configuration and a sixth folded configuration, respectively.

The game board 201 can be moved from the fourth configuration to the fifth configuration by folding the game board 201 along the central lateral fold line 220, as shown by the arrow HH in FIG. 10. Similarly stated, the game board 201 is folded substantially in half about the central lateral fold line 220 such that the first lateral fold line 214 is adjacent and/or in contact with the second lateral fold line 214'. In this manner, the first lateral fold line 214 and the second lateral fold line 214' collectively form an edge of the game board 201 opposite the central lateral fold line 220. When the game board 201 is in the fifth configuration, the first surface 202 of the game board 201 remains disposed between the two folded portions of the second surface 204 of the game board 201. As shown in FIG. 10, when the game board 201 is in the fifth configuration, the first set of indicia 207 are exposed and/or displayed when viewed in a direction towards the portion second surface 204 facing the exterior region of the folded game board 201, as shown by the arrow V" in FIG. 10. The second set of indicia 207' are exposed and/or displayed when viewed in a direction towards the portion second surface 204 facing the inner region of the folded game board 201, as shown by the arrow V'" in FIG. 10.

When the game board 201 is in the fifth configuration, a game piece 250 can be coupled to each of the edges 214, 214' adjacent the open-ended portion of the cuff folds 228, 228', as shown in FIG. 10. Similarly stated, the game pieces 250 can be used to secure and/or retain the edges 214, 214' of the game board 201 adjacent the longitudinal edges 215, 215'. In this manner, the folded portions of the perimeter 210 of the game board 201 form pockets 224 that are closed on three sides. The pockets 224 are configured to receive at least a portion of an object 256 (see e.g., FIG. 12). The object 256 can be any suitable memorabilia of the types described herein. In this manner, when the game board 201 is in the fifth configuration, the game board 201 includes two pages 240 and can be placed on a surface (e.g., a desk, table or the like) on the edges 215, 215. Similarly stated, when the game board 201 is in the fifth configuration, the game board 201 can be a self-standing display device (e.g., a desktop picture frame or the like).

Figure 11:
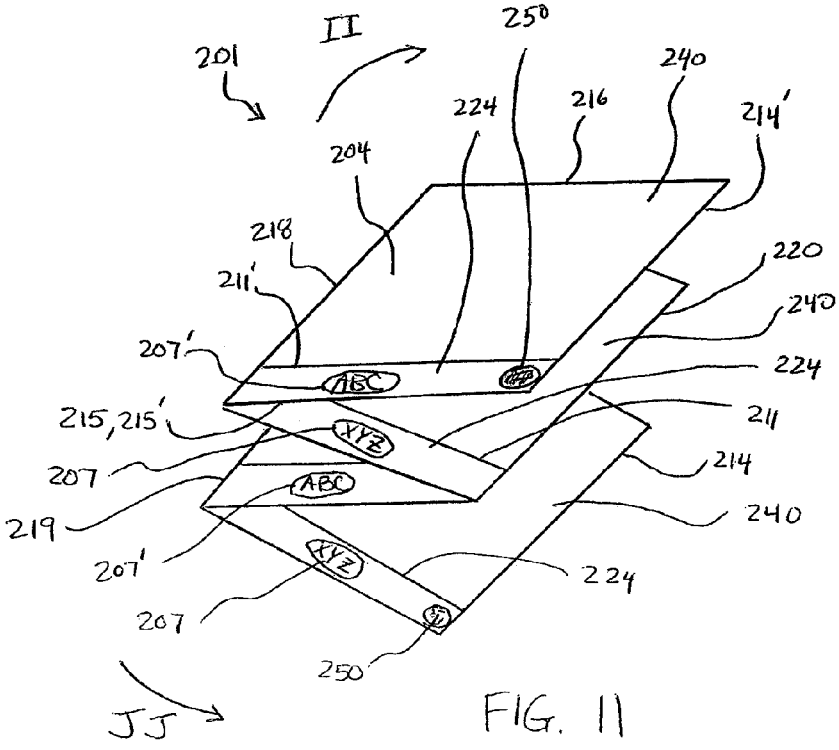

The game board 201 can be moved from the fifth configuration to the sixth configuration by folding the game board 201 along the third lateral fold line 218 and the fourth lateral fold line 219, as shown by the arrows II and JJ, respectively, in FIG. 11. Similarly stated, the game board 201 is folded about the central lateral fold line 220 such that the first lateral fold line 214 and the second lateral fold line 214' are each adjacent to and/or in contact with the central lateral fold line 220. In this manner, the third lateral fold line 218 and the fourth lateral fold line 219 collectively form an edge of the game board 201 opposite the central lateral fold line 220.

When the game board 201 is in the sixth configuration, the game board 201 includes four pages 240, each of which display a portion of the second surface 204 of the game board 201. Similarly stated, when the game board 201 is in the sixth configuration, the game board 201 is folded in an accordion-like fashion to define the four pages 240. Thus, when the game board 201 is in the sixth configuration, the game board 201 can be a self-standing display device (e.g., a desktop picture frame or the like). Each of the pages 240 has a first side and a second side, and each of the sides includes a pocket 224. As described above, the pockets 224 are configured to retain a portion of an object 256. Moreover, the first set of indicia 207 and the second set of indicia 207' are disposed on the pockets 224 on alternating sides of each page 240. In this manner, the indicia 207, 207' can serve as labels, identifiers and/or captions associated with the objects 256 disposed within the pockets 224.

Figure 12:
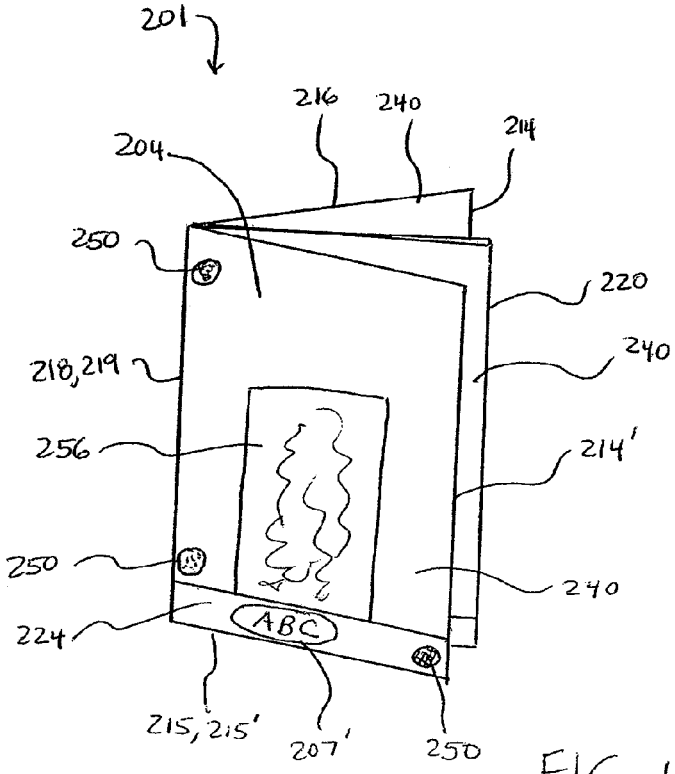

The game board 201 can be moved from the sixth configuration to the seventh configuration by coupling the third lateral fold line 218 and the fourth lateral fold line 219 together, as shown in FIG. 12. When the game board 201 is in the seventh configuration, the third lateral fold line 218 and the fourth lateral fold line 219 form a spine of a booklet or album. Similarly stated, the game board 201 can form a booklet or album having three pages 240, each of which includes two sides. Each of the sides of the pages 240 includes a pocket 224 configured to contain an object 256 of the types described herein.

As shown in FIG. 12, the third lateral fold line 218 and the fourth lateral fold line 219 are coupled together using two game pieces 250. In other embodiments, however, the third lateral fold line 218 and the fourth lateral fold line 219 can be coupled together using any suitable mechanism. In some embodiments, for example, the third lateral fold line 218 and the fourth lateral fold line 219 can be coupled together using a pin, a staple, a clip or the like. In other embodiments, the third lateral fold line 218 and the fourth lateral fold line 219 can be coupled together using a self-adhesive portion of the second surface 204 of the game board 201.

Figure 13:
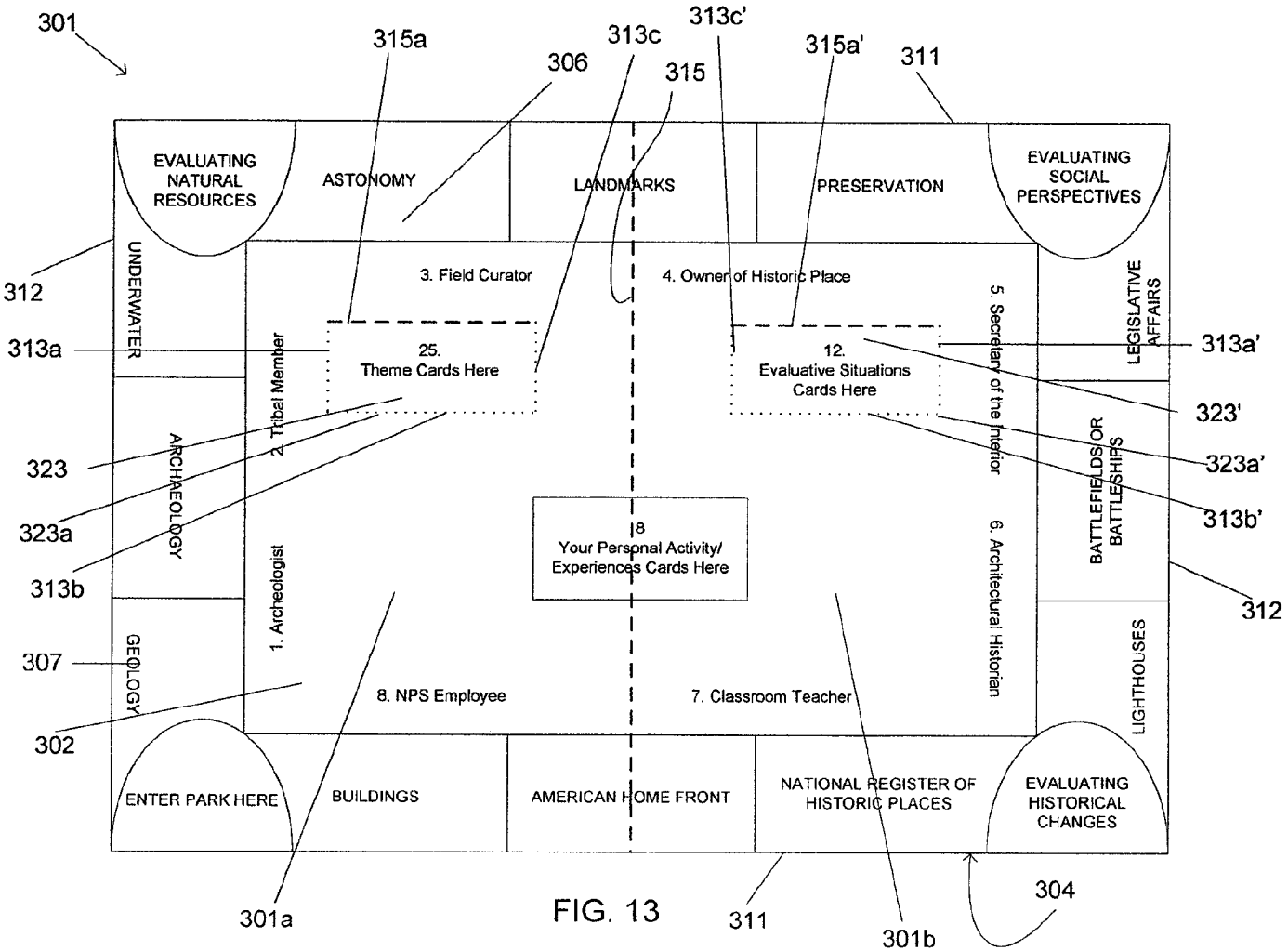
FIG. 13 is a top view of game board in a expanded configuration according to an embodiment.
Figure 14:
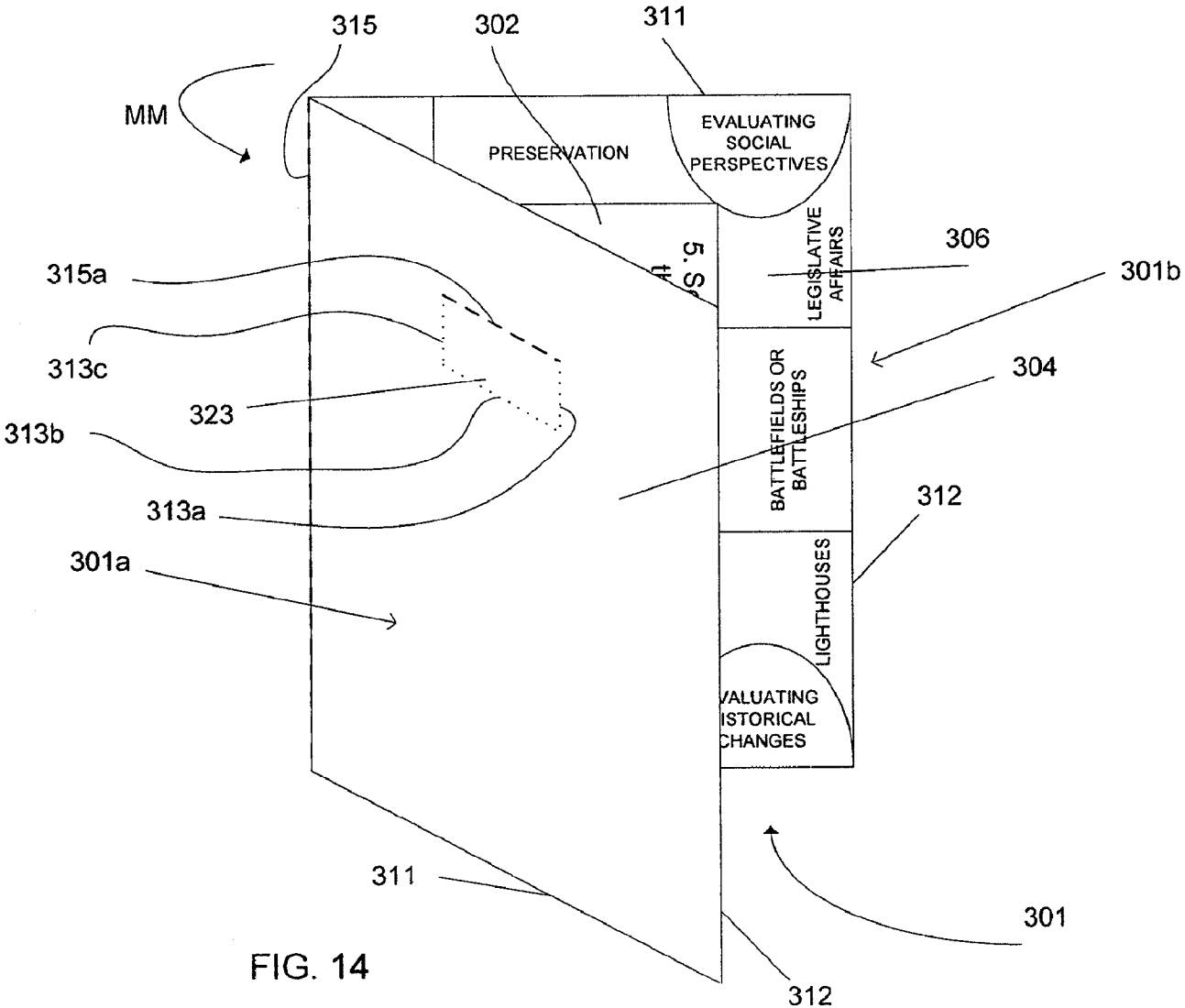
FIGS. 14 and 15 are perspective views of the game board of FIG. 13. in a collapsed configuration.
Figure 15:
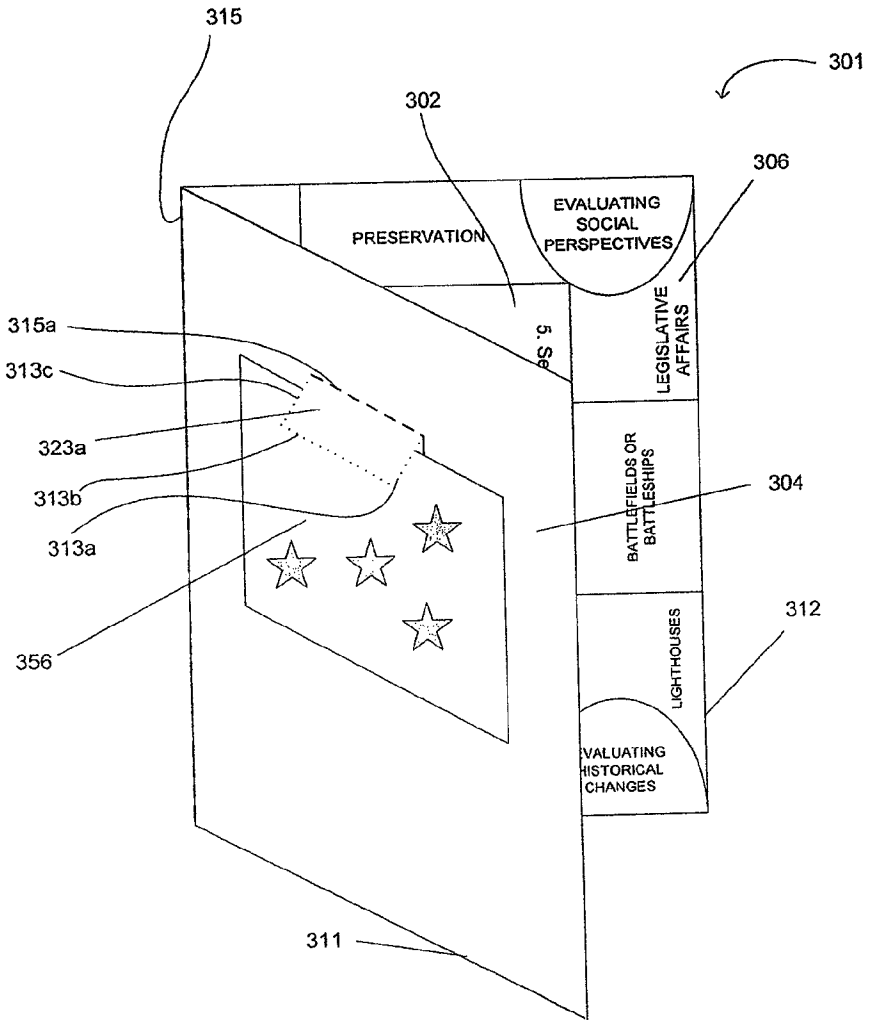

Although the game boards 101, 201 disclosed are shown and described as including pockets (e.g., 124, 224) configured to receive at least a portion of an object (e.g., 156, 256), in other embodiments an object can be retained to a game board by any suitable mechanism. For example, FIGS. 13-15 illustrate a game board 301 according to an embodiment including a retention portion configured to retain an object 356 to the game board 301.

The game board 301 has a first side 302 and a second side 304 and includes a first retention portion 323 and a second retention portion 323'. The game board has an expanded configuration (e.g. FIG. 13) and a collapsed configuration (e.g., FIGS. 14 and 15). The game board 301 has a center fold line 315, shown by a dashed line in FIG. 13, which divides the game board 301 into a first half 301*a* and a second half 302*b*. The center fold line 315 is substantially parallel to the lateral edges 312 of the game board 301. Similarly stated, the center fold line 315 is substantially normal to the longitudinal edges 311. In other embodiments, however, the center fold line 315 can be non-parallel to and/or non-normal to the lateral edges 312 of the game board 301.

The first side 302 of the game board 301 includes a set of markings 306 associated with the game. The markings 306 include indicia 307 (e.g., spaces and/or outlines) upon which a game piece can be placed when the game is being played. The indicia 307 can be any suitable indicia associated with the game, the game topic and/or the players of the game. In the illustrated embodiment, the indicia 307 includes insignia associated with a national park (e.g., landmarks, preservation, history, legislative affairs, geology, archaeology, buildings and/or the like).

The first retention portion 323 includes a first fold line 315*a* and a first perforated portion 323*a*. The second retention portion 323' includes a second fold line 315*a'* second perforated portion 323*a'*. In the illustrated embodiment, the first retention portion 323 is disposed on the first half 301*a* of the game board 301, and the second retention portion 323' is disposed on the second half 301*b* of the game board 301, however other configurations are possible. For example, in some embodiments, the first and second retention portions can be disposed on the first half of the game board. In other embodiments, the first and second retention portions can be disposed in the second half of the game board.

As shown in FIG. 13, the first perforated portion 323*a* includes a first vertical line 313*a*, a second vertical line 313*c*, and a horizontal line 313*b* connecting the first and second vertical lines 313*a*, 313*c*. The first vertical line 313*a*, the second vertical line 313*c*, and the horizontal line 313*b* are configured to be separated from the game board 301 allowing the first retention portion 323 to pivot along the first fold line 315*a*. Similarly, the second perforated portion 323*a'* includes a first vertical line 313*a'*, a second vertical line 313*c'*, and a horizontal line 313*b'* connecting the first and second vertical lines 313*a'*, 313*c'*. The first vertical line 313*a'*, the second vertical line 313*c'*, and the horizontal line 313*b'* are configured to be separated from the game board 301 allowing the second retention portion 323' to pivot along the second fold line 315*a'*.

As shown in FIG. 13, when the game board 301 is in the expanded configuration, the game board 301 is substantially planar. More particularly, when the game board 301 is in the expanded configuration, lateral edges 312 of the game board 301 and longitudinal edges 311 of the game board 301 define a substantially rectangular, flat playing surface.

As shown, the game board 301 can be moved between the expanded configuration and the collapsed configuration by folding the game board 301 along the center fold line 315 as shown by arrow MM in FIG. 14. In the illustrated embodiment, the game board 301 is folded along the center fold line 315 such that the game board is folded into the first half 301*a* and the second half 301*b*. Said another way, the game board 301 is folded to form two distinct pages. Similarly stated, the game board 301 is folded substantially in half about the center fold line 315 inward towards the first side 302 of the game board 301. In this manner, the second side 304 of the game board 301 is exposed.

When the game board 301 is in the collapsed configuration, the first vertical line 313*a*, the second vertical line 313*c*, and the horizontal line 313*b* can be separated from the game board 301 such that the first retention portion 323 can be pivoted toward the second side 304 of the game board 301. Similarly, the first vertical line 313*a'*, the second vertical line 313*c'*, and the horizontal line 313*b'* can separated from the game board 301 such that the second retention portion 323' can be pivoted toward the second side 304 of the game board 301. In this manner, as shown in FIG. 15, the first retention portion 323 and the second retention portion 323' can receive and/or retain an object 356. The perforated lines 313*a*, 313*b*, 313*c*, 313*a'*, 313*b'*, 313*c'* can be configured such that the first perforated portion 323*a* and the second perforated portion 323*a'* can be separated and/or disengaged from the game board 301 without any cutting tools. In other embodiments, however, the perforated lines 313*a*, 313*b*, 313*c*, 313*a'*, 313*b'*, 313*c'* can include creases, markings and/or seams. In yet other embodiments, the perforated lines 313*a*, 313*b*, 313*c*, 313*a'*, 313*b'*, 313*c'* can be configured such that a cutting tool, such as, for example, a portion of a game piece (not shown) can be used to assist in separating the first perforated portion 323*a* and/or the second perforated portion 323*a'* from the game board 301.

In this manner, the game board 301 can be converted from a substantially planar surface associated with the game to a folded surface configured to contain memorabilia (e.g., the object 356). Similarly stated, in this manner, the game board 301 can be converted from a substantially planar surface associated with the game to a display device configured to be displayed in an upright position (e.g., a scrapbook page, a desk display or the like) configured to contain memorabilia.

Although the game board 301 is described and illustrated as being in its collapsed configuration when the first half 301*a* of the game board 301 is folded about the center fold line 315 toward the second half 301*b* of the game board 301 such that the second side 304 of the game board is exposed, it should be understood that other configurations are possible. For example, in some embodiments, the first half of the game board is folded about the center fold line toward the second half of the game board such that the first side of the game board is exposed.

Although the game board 301 is shown and described as being foldable to include two portions and/or pages (e.g., the first half 301*a* and the second half 301*b*), each portion including a single retention portion, in other embodiments, a game board can be folded to include any number of distinct portions (i.e., pages). For example, FIGS. 16-22 illustrate a game board 401 according to an embodiment configured to be converted into a display device having multiple pages.

The game board 401 has a first side 402 and a second side 404 and has a first configuration, a second configuration, and a third configuration. The game board 401 has a first fold line 414, a second fold line 415*a*, and a third fold line 415*b*, shown by dashed lines in FIG. 16. The first fold line 414 is substantially parallel to the longitudinal edges 411 of the game board 401 and divides the game board 401 in half. The second and third fold lines 415*a*, 415*b* are substantially parallel to the lateral edges 412 of the game board 401. Similarly stated, the first fold line 414 is substantially normal to the lateral edges 412 of the game board 401 and the second and third fold lines 415*a*, 415*b* are substantially normal to the longitudinal edges 411. In other embodiments, however, the first fold line 414 can be non-parallel to and/or non-normal to the lateral edges 412 of the game board 401 and the second and third fold lines 415*a*, 415*b* can be non-parallel to and/or non-normal to the longitudinal edges 411 of the game board 401.

Figure 16:
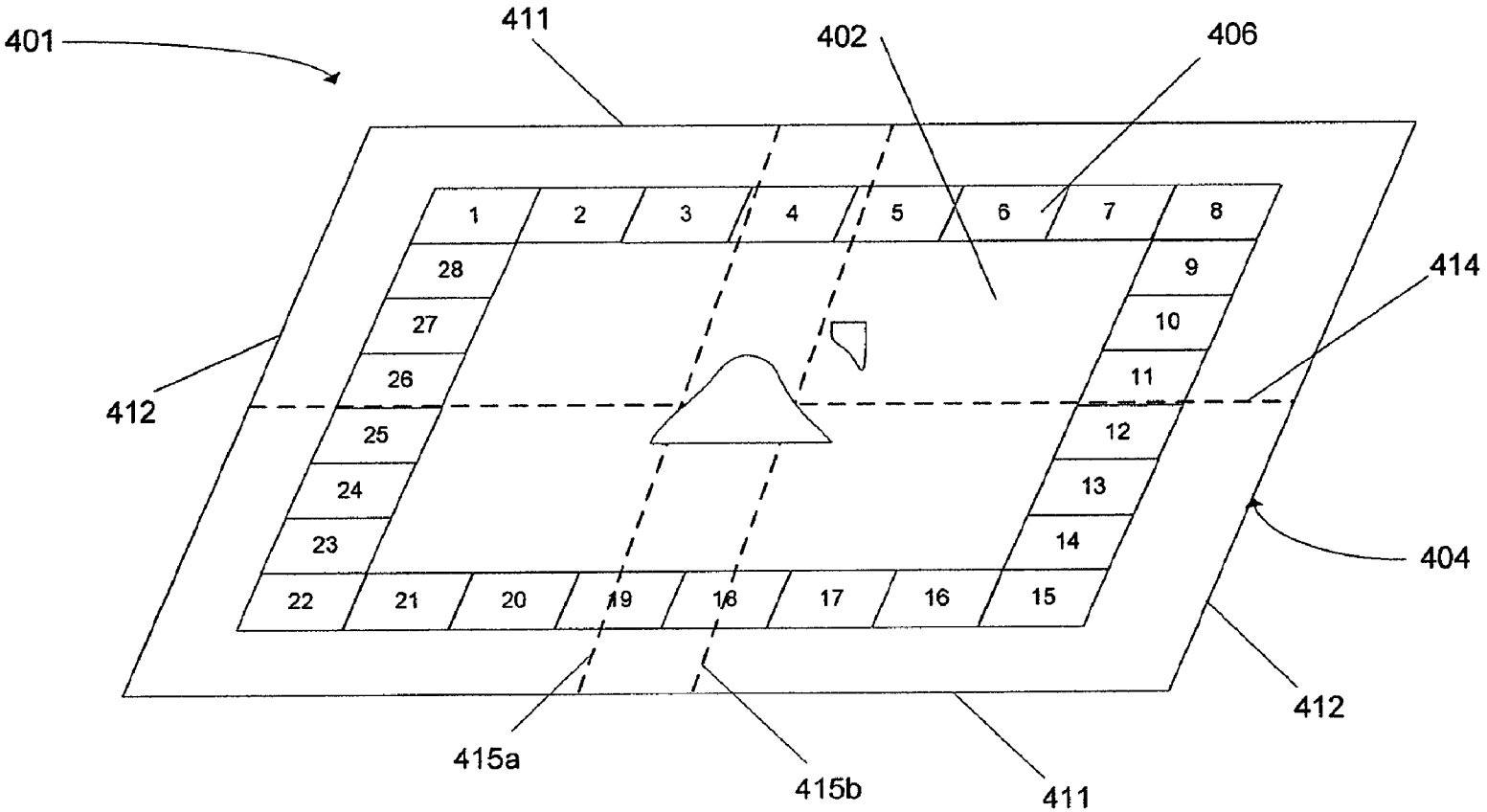
FIG. 16 is a perspective view of a game board in a first configuration according to an embodiment.
Figure 21:
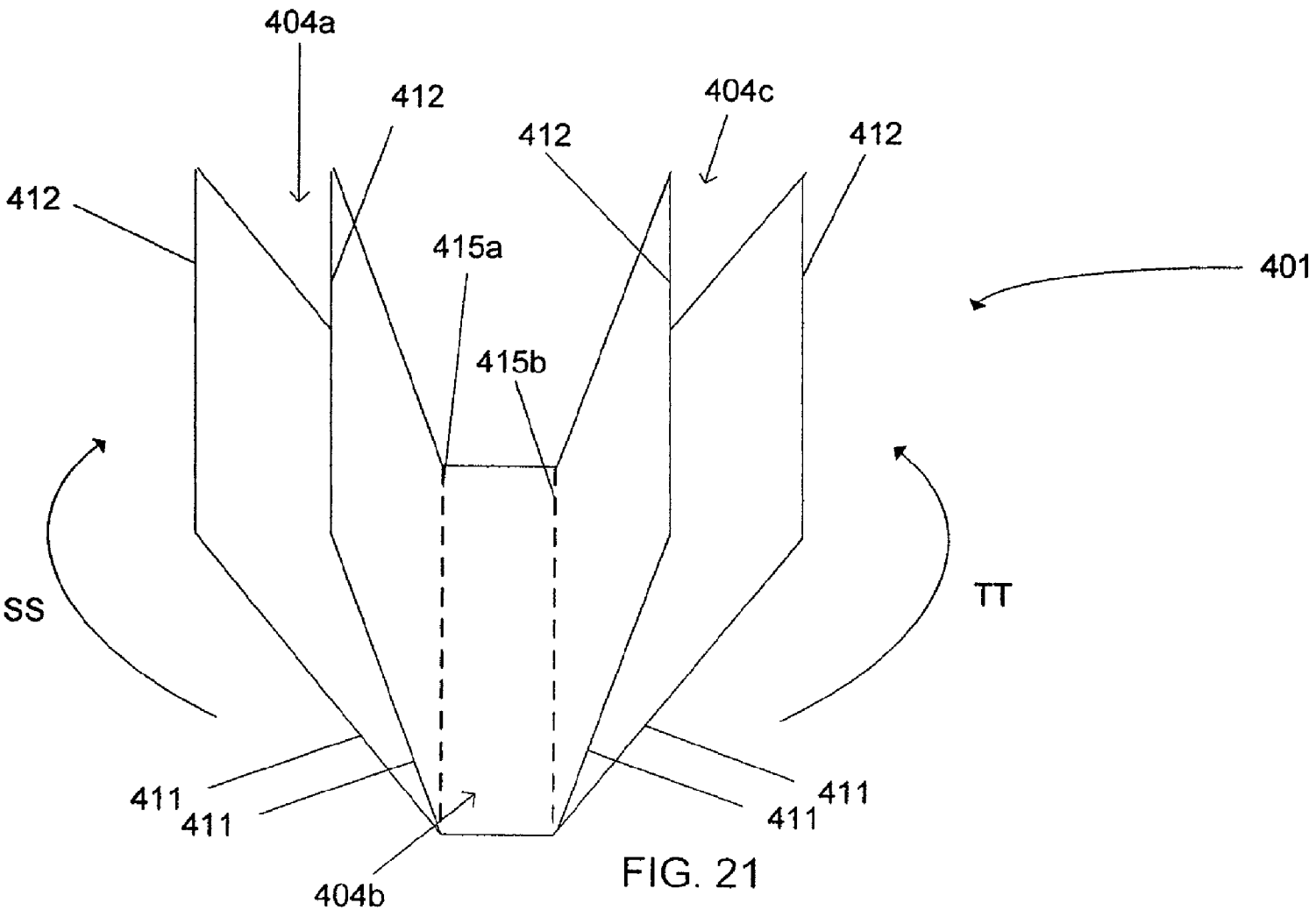
FIGS. 21 and 22 are side perspective views of the game board of FIG. 16 in the third configuration.
Figure 22:
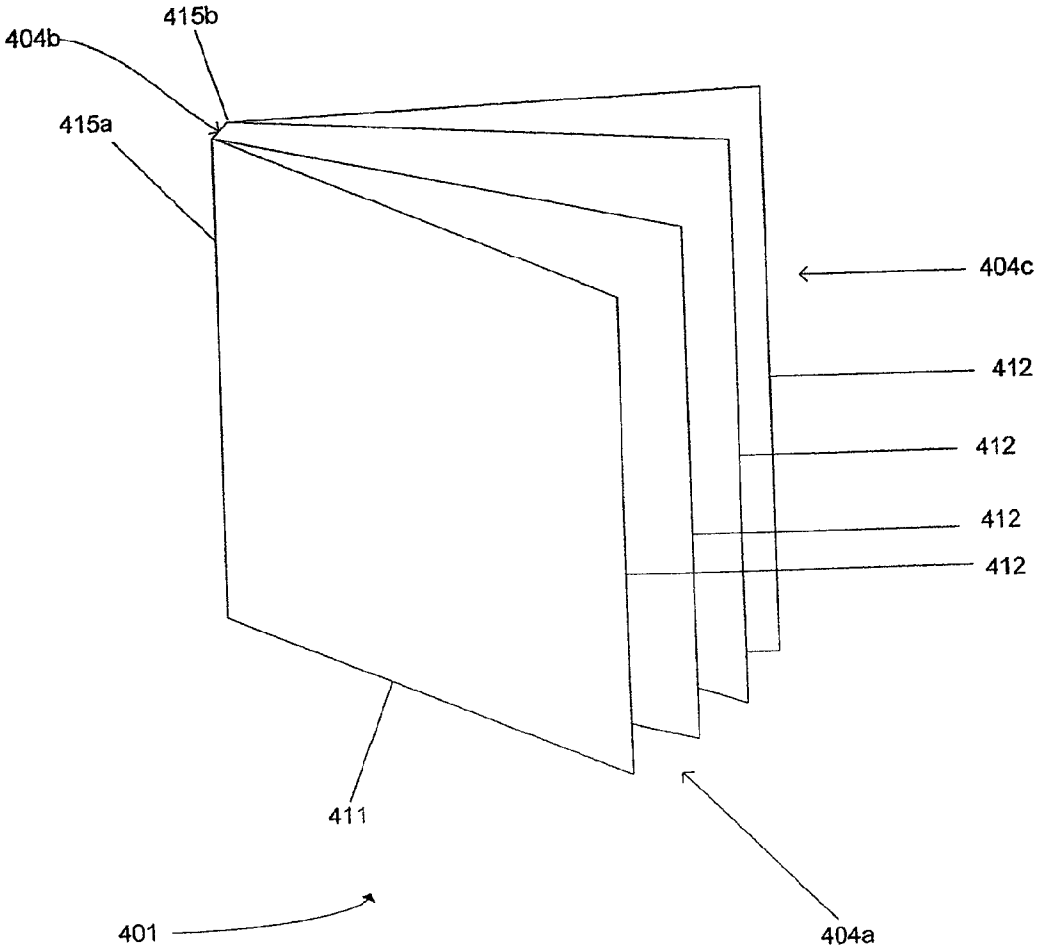

The first fold line 414, the second fold line 415*a*, and the third fold line 415*b* are configured to assist the user in moving the game board between the first configuration, the second configuration and the third configuration. In this manner, the game board 401 is configured to be folded in a predetermined manner and/or sequence when moved between an expanded configuration (e.g., the first configuration, as shown in FIG. 16) and a collapsed configuration (e.g., the third configuration, as shown in FIGS. 21 and 22).

Figure 17:
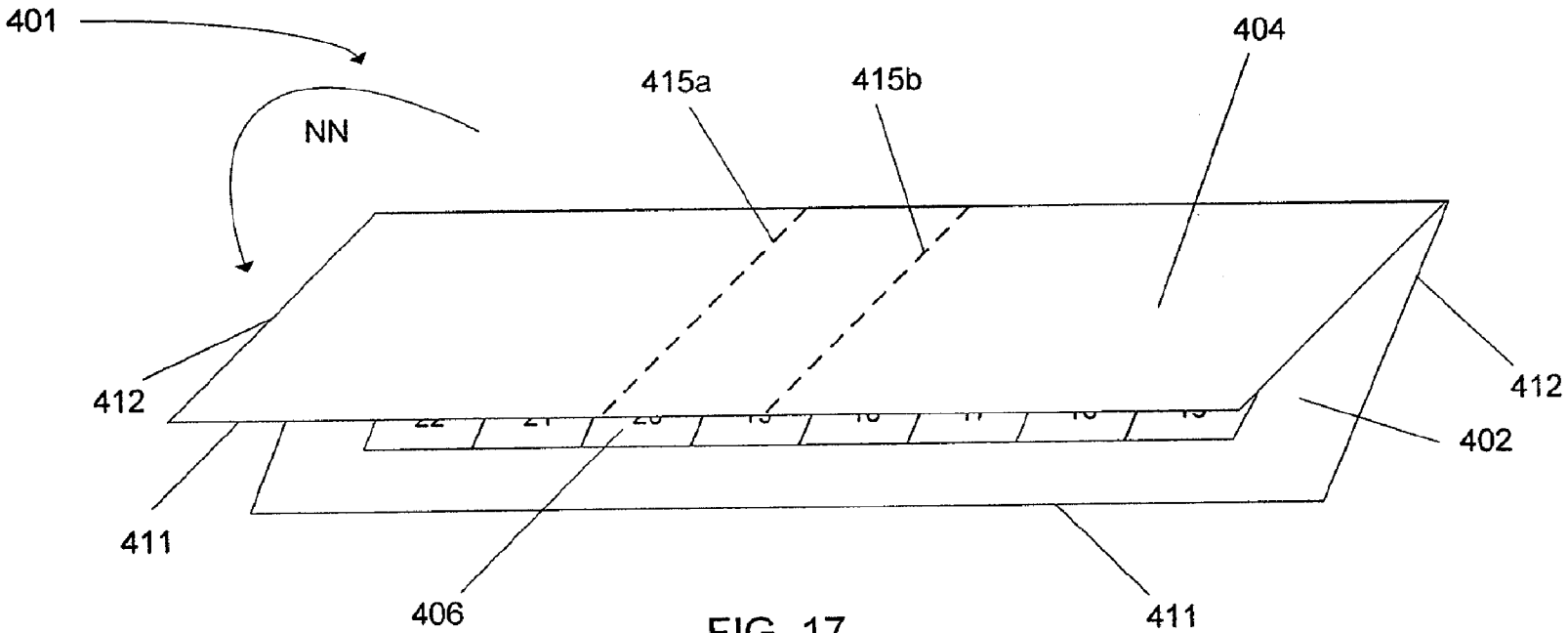
FIGS. 17 and 18 are perspective views of the game board of FIG. 16 in a second configuration.

The game board 401 can be moved from the first configuration to the second configuration by folding the game board 401 in half longitudinally along the first fold line 414 as shown by the arrow NN in FIG. 17. More particularly, the game board 401 is folded in a direction as indicated by arrow NN about the first fold line 414 such that the longitudinal edges 411 of the game board 401 are adjacent each other. In this manner, the second side 404 of the game board 401 is exposed. Similarly stated, the game board 401 is moved from the first configuration to the second configuration by folding the game board 401 toward the first side 402 of the game board 401.

Figure 18:
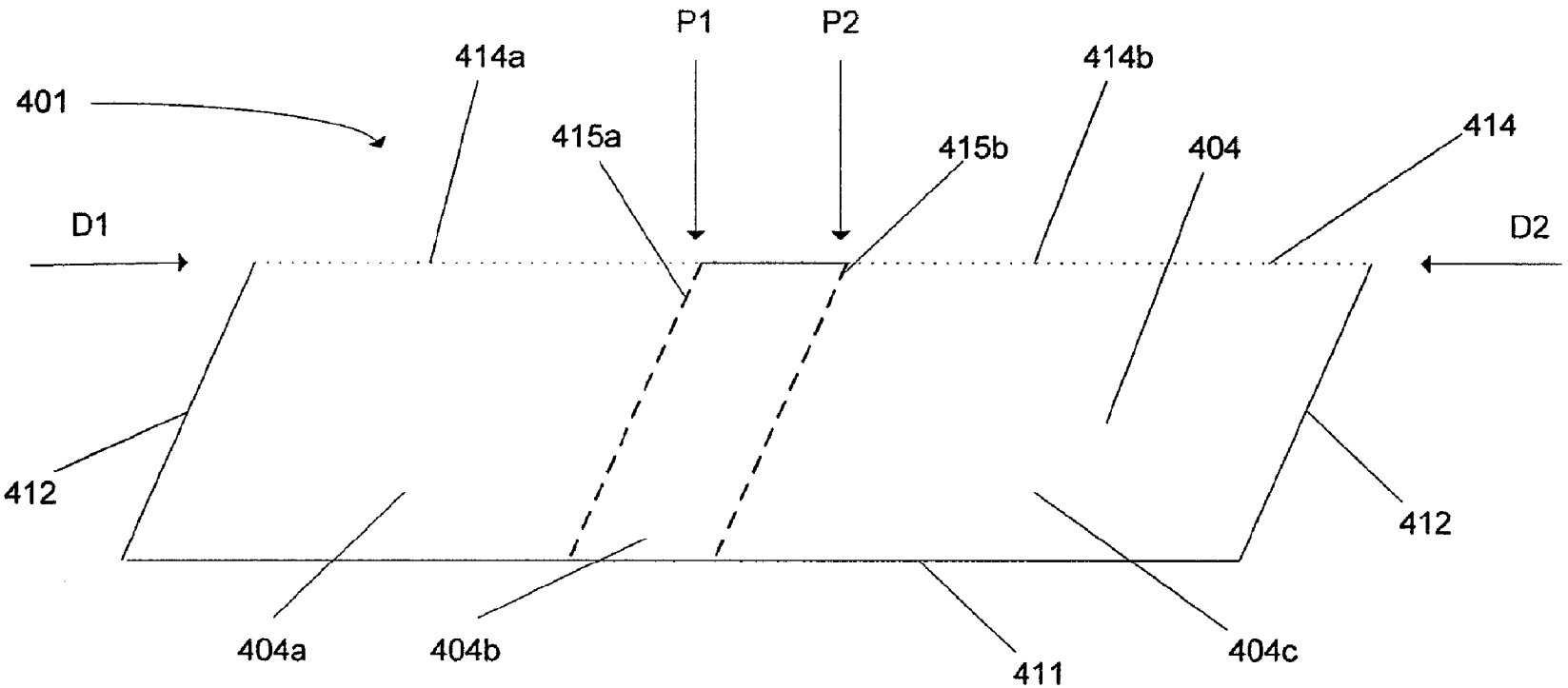

When the game board 401 is in the second configuration, the game board 401 includes a first section 404*a*, a second section 404*b*, and a third section 404*c* between the first section 404*a* and the second section 404*b*. The first fold line 414 is configured to be separated (e.g., cut, torn, severed, ripped) from the lateral edges 412 inward along the first fold line 414. Specifically, a first portion 414*a* of the first fold line 414 is configured to be separated from a first lateral edge 412*a* in a first direction (as shown by the arrow D1 in FIG. 18) to a location P1 where the first fold line 414 and the second fold line 415*a* intersect. Similarly, a second portion 414*b* of the first fold line 414 is configured to be separated from a second lateral edge 412*b* in a second direction (as shown by the arrow D2 in FIG. 18) to a location P2 where the first fold line 414 and the third fold line 415*b* intersect. The first portion 414*a* and the second portion 414*b* of the first fold line 414 are illustrated in FIG. 18 by dotted lines.

In some embodiments, the first portion 414*a* and/or the second portion 414*b* can have a different configuration than the remainder of the first fold line 414. Similarly stated, in some embodiments, the portions of the first fold line 414 configured to be separated (i.e., the first portion 414*a* and the second portion 414*b*) can have a perforation and the remainder of the first fold line 414 can include a crease, seam or the like. In this manner, the game board 401 is configured to be folded and/or separated in a predetermined sequence and/or manner.

By cutting the first portion 414*a* and the second portion 414*b* of the first fold line, the game board 401 can be converted into a device having multiple pages. Specifically, in the illustrated embodiment, the first section 404*a* includes two distinct pages (see e.g., FIG. 19), and the third section 404*c* includes two distinct pages (see e.g., FIG. 20).

Figure 19:
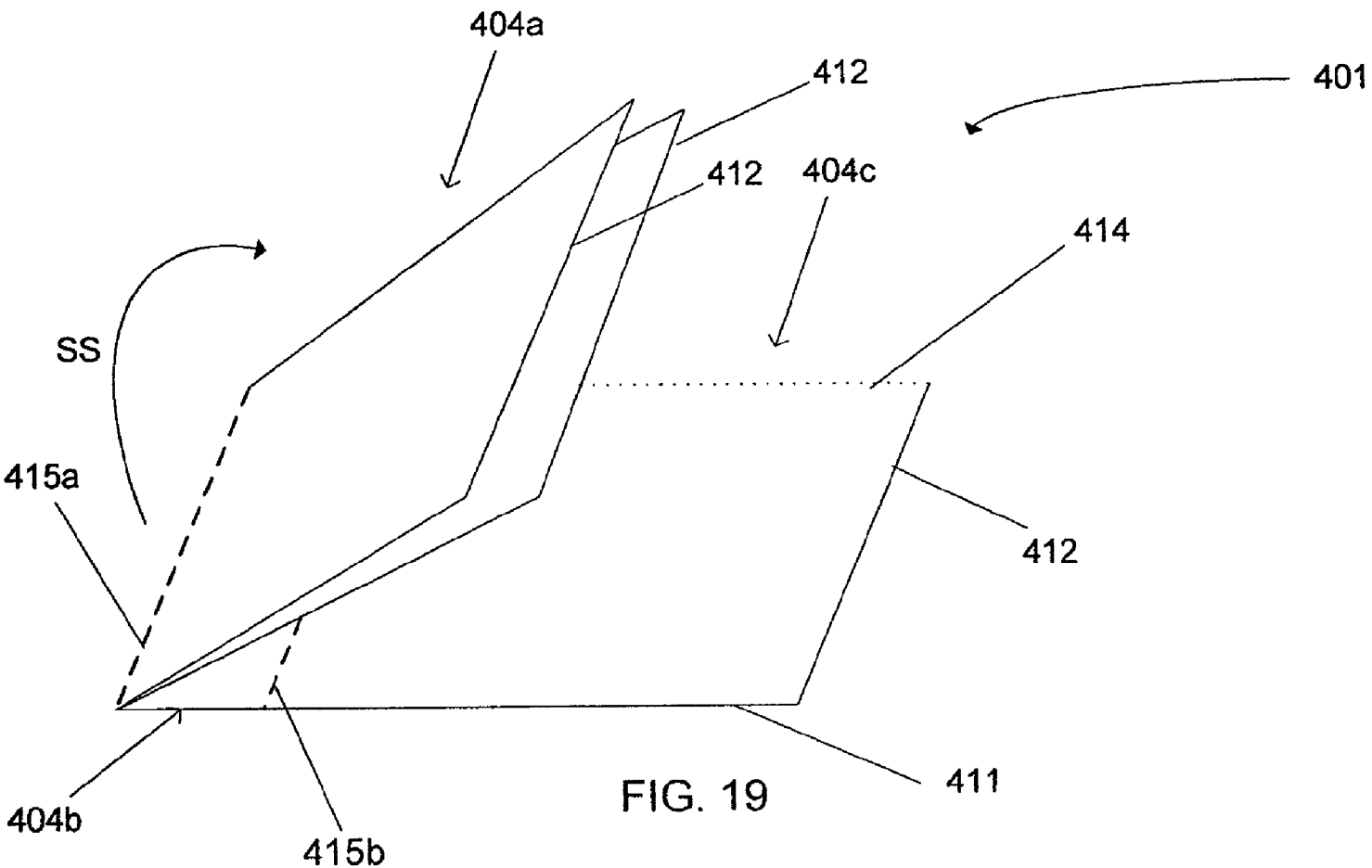
FIGS. 19 and 20 are perspective views of the game board of FIG. 16 moving from the second configuration to a third configuration.
Figure 20:
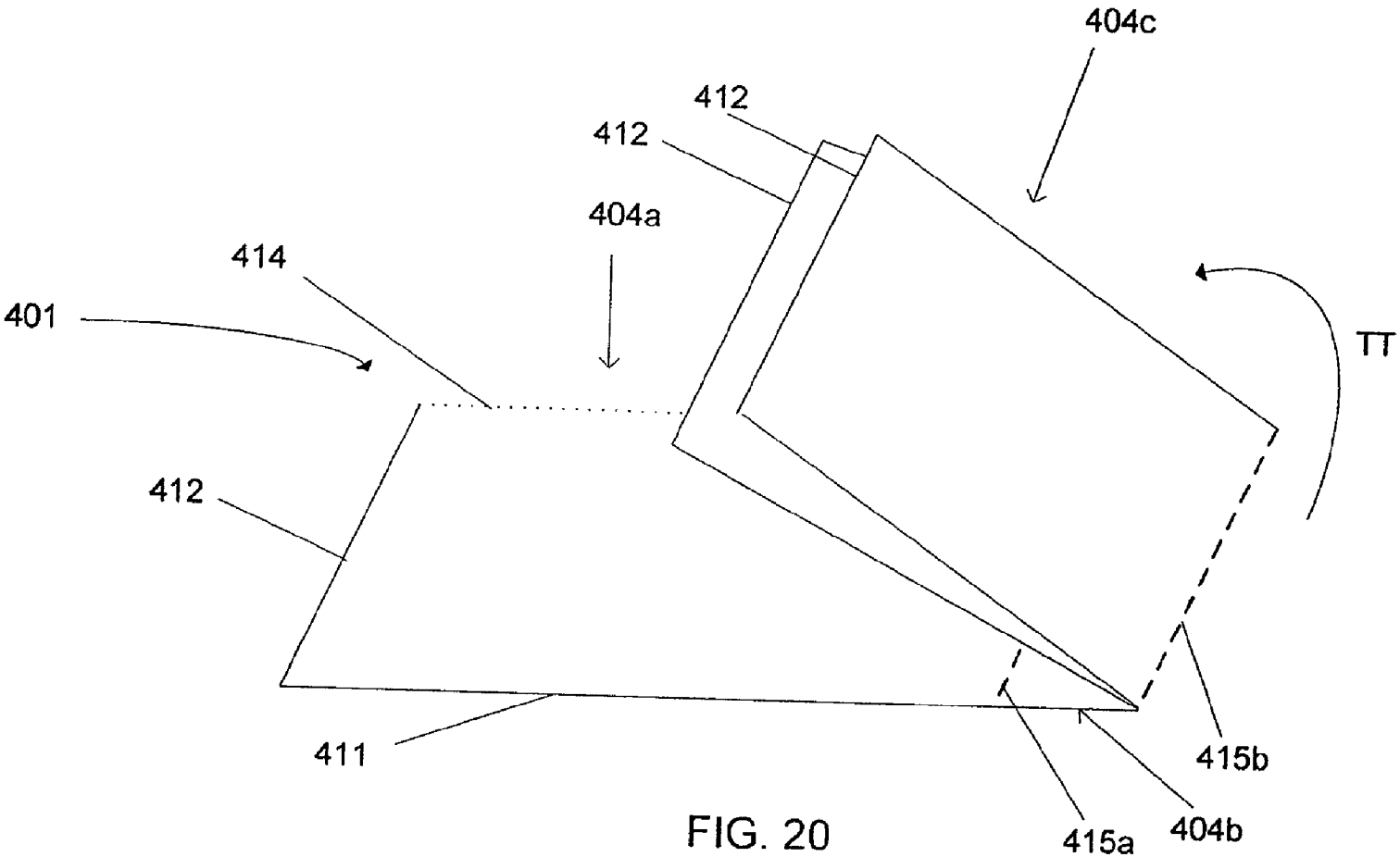

The game board 401 can be moved from the second configuration to the third configuration (i.e., collapsed configuration) by folding the game board 401 along the second and third fold lines 415*a*, 415*b* as shown by the arrows SS and TT in FIGS. 19-22. More particularly, as shown in FIGS. 19 and 20, the first section 404*a*, including two separate pages, is folded upward along the second fold line 415*a* as indicated by arrow SS, and the third section 404*c*, including two separate pages, is folded upward along the third fold line 415*b* as indicated by arrow TT.

When the game board 401 is in the third configuration (e.g., the collapsed configuration), the game board 401 is in a book-like (e.g., pamphlet-like) configuration, shown, for example, in FIGS. 21 and 22. The first section 404*a* and the third section 404*c* each include a plurality of pages. The second section 404*b*, along with the first and second sections 404*a*, 404*c* assist in supporting the game board 401 in an upright position. In this manner, the game board 401 is converted from a substantially planar surface associated with the game (i.e., first configuration) into a folded configuration (i.e., third configuration) configured to contain and/or retain memorabilia (e.g., the object). Similarly stated, in this manner, the game board 401 is converted from a substantially planar surface associated with the game to a display device (e.g., a scrapbook page, a desk display or the like) configured be self supported in an upright position.

In some embodiments, when the game board 401 is in the third configuration (i.e., collapsed configuration), the first section 404*a* and the third section 404*c* can be secured together by a coupling member (not illustrated). For example, in some embodiments, a coupling member can form a portion of a spine of the booklet formed by the game board 401. The coupling member can be have many different suitable configurations for securing the first and third sections 404*a*, 404*c*. For example, in some embodiments, the coupling member can be a game piece associated with the game and/or game topic. In such embodiments, the game piece can be a pin (e.g., a lapel pin, a decorative pin, or the like) associated with the game and/or the game topic. For example, in some embodiments, the game topic can be associated with a particular national park and the game pieces can include an insignia or emblem associated with the particular national park.

Although the game board 401 is illustrated and described above as having a collapsed configuration without pockets or retention portions, in other embodiments the game board 401 can include pockets within which memorabilia can be retained. For example in some embodiments, additional folds can be incorporated to provide pockets configured to receive an object. In other embodiments, the game board 401 can include retention portions similar to the retention portions 323 shown and described above. In such embodiments, the retention portions can include fold lines and/or perforated portions configured to allow the retention portions to be separated from the game board, as described above.

Although the game board 401 is shown and described above as being foldable along vertical fold lines (e.g., second and third fold lines 415*a*, 415*b*) and horizontal fold lines (e.g., the first fold line 414), in other embodiments, a game board can include one or more diagonal fold lines. For example, FIGS. 23-30 show a game board 501 according to an embodiment.

The game board 501 has a first side 502 and a second side 504 and has a first configuration, a second configuration, a third configuration, a fourth configuration, and a fifth configuration. The game board 501 includes a plurality of horizontal fold lines (515, 520, 520'), a plurality of vertical fold lines (515*a*, 515*b*, 515*c*, 515*d*, 519*a*, 519*b*), and two diagonal fold lines (518*a*, 518*b*), all shown as dashed lines in FIG. 23. The horizontal fold lines (515, 520, 520') are substantially parallel to first and second longitudinal edges 511, 511' of the game board 501. The vertical fold lines 515*a*-515*d*, 519*a*, 519*b* are substantially parallel first and second lateral edges 512, 512' of the game board 510. Similarly stated, the horizontal fold lines (515, 520, 520') are substantially normal to the lateral edges 512, 512' of the game board 501 and the vertical fold lines (515*a*, 515*b*, 515*c*, 515*d*, 519*a*, 519*b*) are substantially normal to the first and second longitudinal edges 511, 511'. The first diagonal fold line 518*a* extends from the first longitudinal edge 511 to the first lateral edge 512. Similarly, the second diagonal fold line 518*b* extends from the first longitudinal edge 511 to second lateral edge 512'.

Figure 23:
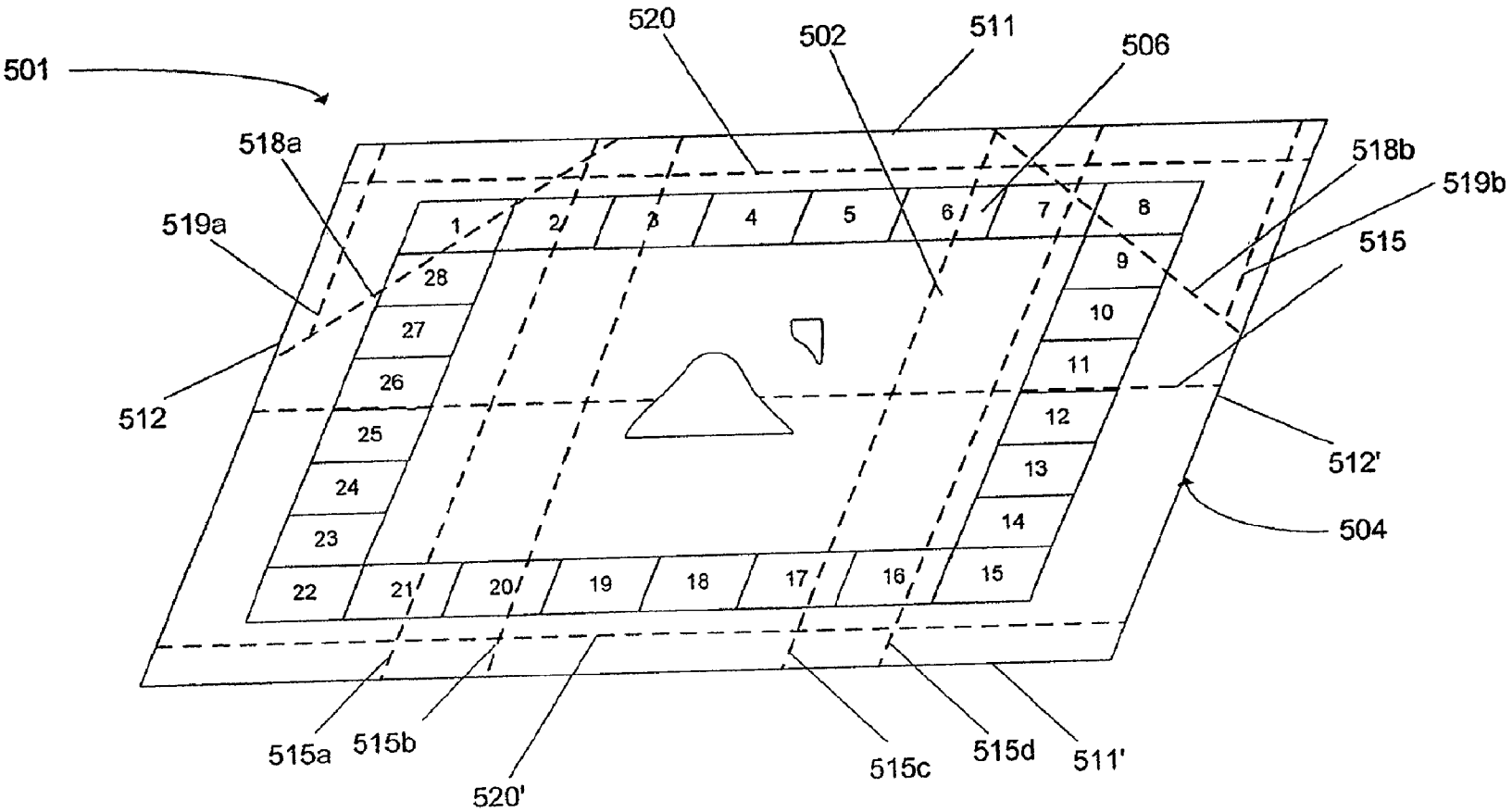
FIG. 23 is a perspective view of a game board in a first configuration according to an embodiment.
Figure 29:
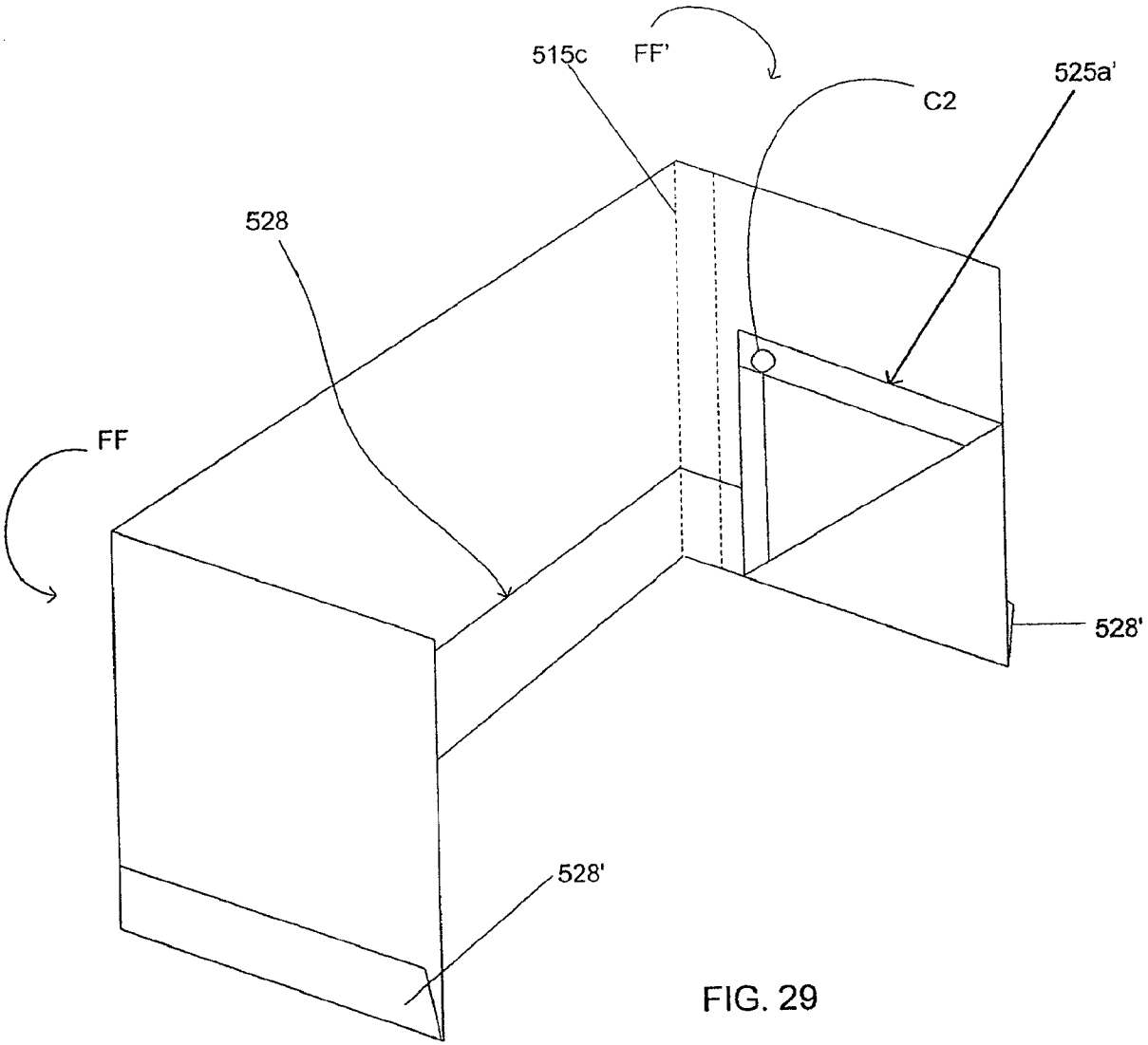
FIGS. 29 and 30 are perspective views of the game board of FIG. 23 in a fifth configuration.
Figure 30:
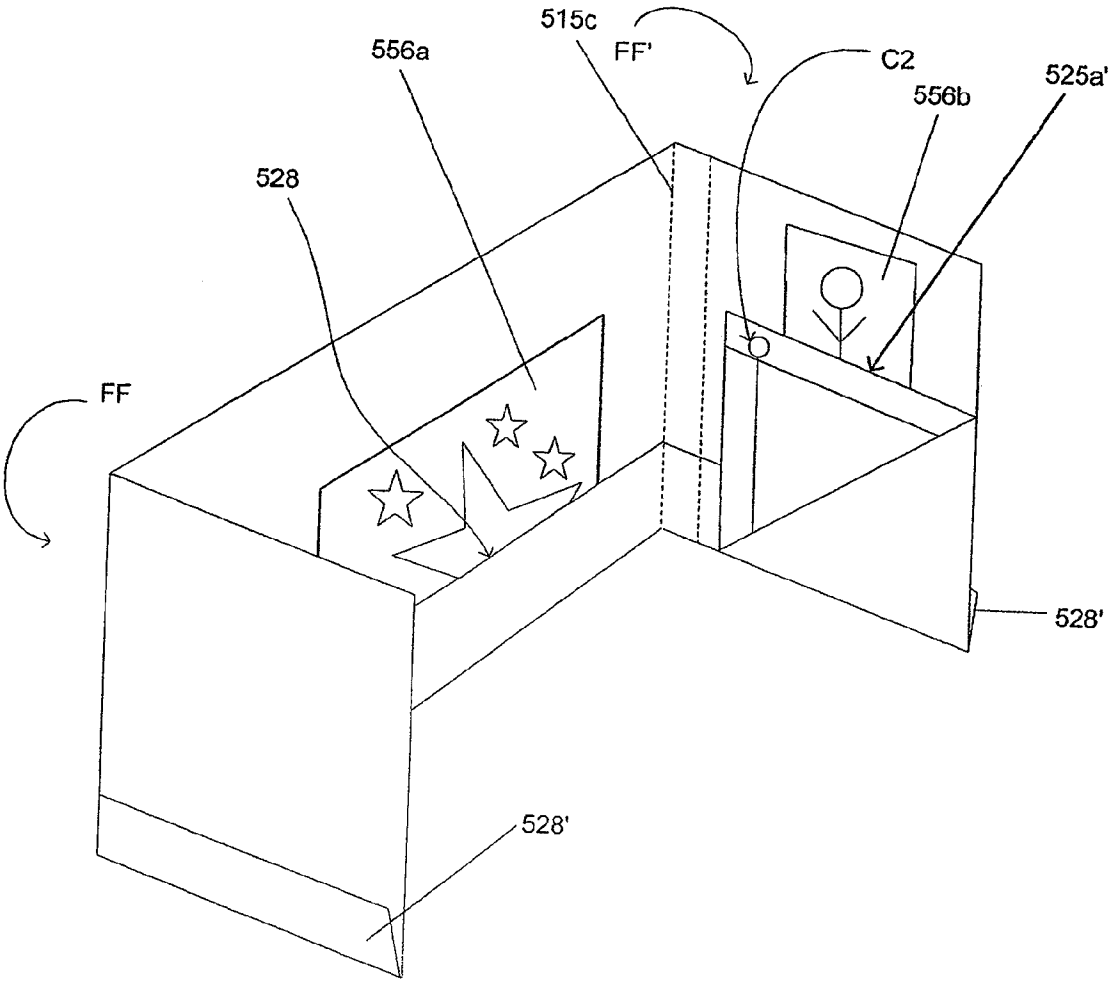

The horizontal fold lines (515, 520, 520'), the vertical fold lines (515*a*, 515*b*, 515*c*, 515*d*, 519*a*, 519*b*), and the first and second diagonal fold lines 518*a*, 518*b*, are configured to assist the user in moving the game board 501 between the first configuration, the second configuration the third configuration, and the fourth configuration. In this manner, the game board 501 is configured to be folded in a predetermined manner and/or sequence when moved between an expanded configuration (e.g., the first configuration, as shown in FIG. 23) and a collapsed configuration (e.g., the fifth configuration, as shown in FIGS. 29 and 30). In some embodiments, the fold lines can include markings to assist the user in folding the game board as described below. In other embodiments, the fold lines can include a crease, perforations, a seam and/or a pre-stressed portion configured to assist the user in folding the game board 501. In yet other embodiments, at least a portion of the fold lines can include a perforation configured to assist the user in separating a portion of the game board 501 to move the game board 501 between configurations.

The first side 502 of the game board 501 includes a set of markings 506 associated with the game. The markings 506 can include indicia, spaces and/or outlines upon which a game piece (not illustrated) can be placed when the game is being played. The indicia can be any suitable indicia associated with the game, the game topic and/or the players of the game.

Figure 24:
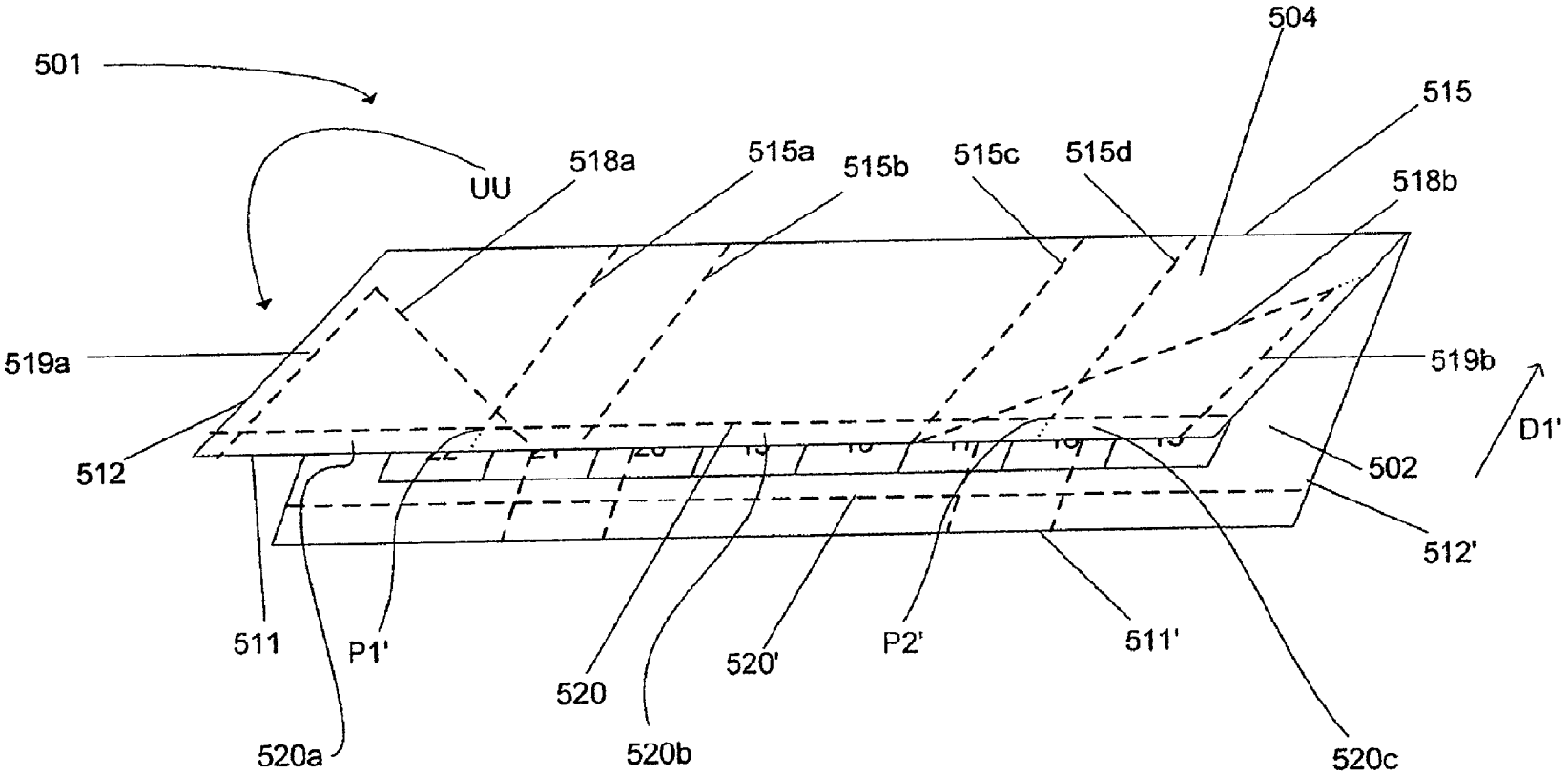
FIG. 24 is a perspective view of the game board of FIG. 23 in a second configuration.

The game board 501 can be moved from the first configuration to the second configuration by folding the game board 501 in half longitudinally along the first horizontal fold line 515 as shown by the arrow UU in FIG. 24. More particularly, the game board 501 is folded about the first horizontal fold line 515 such that the first and second longitudinal edges 511, 511' of the game board 501 are adjacent each other. In this manner, the second side 504 of the game board 501 is exposed. Similarly stated, the game board 501 is moved from the first configuration to the second configuration by folding the game board 501 toward the first side 502 of the game board 501.

When the game board 501 is in the second configuration, a portion of the game board 501 can be separated (e.g., cut, torn, severed or ripped) from the first longitudinal edge 511 along the first vertical fold line 515*a*. Specifically, a portion of the first vertical fold line 515*a* can be separated from the first longitudinal edge 511 in a first direction D1' to a location to a location P1', where the first vertical fold line 515*a* and the second horizontal fold line 520 intersect (see e.g., FIG. 24). Similarly, a portion of the game board 501 can be separated along the fourth vertical fold line 515*d*. Specifically, a portion of the fourth vertical fold line 515*d* can be cut from the first longitudinal edge 511 in the first direction D1' to a location P2' where the fourth vertical fold line 515*d* and the second horizontal fold line 520 intersect (see, e.g., FIG. 24). Said another way, the first vertical fold line 515*a* and the fourth vertical fold line 515*d* are configured to be cut in a direction as shown by arrow D1' toward the first horizontal fold line 515 (i.e., the center fold line). The portion of the first vertical fold line 515*a* and the portion of the fourth vertical fold line 515*d* are illustrated in FIG. 24 by dotted lines. By cutting the first and second vertical first fold lines 515*a*, 515*d*, multiple sections of the game board 501 are formed along the second horizontal fold line 520. Specifically, in the illustrated embodiment, after being cut, the game board 501 includes a first section 520*a*, a second section 520*b*, and a third section 520*c* along the second horizontal fold line 520 (see, for example, FIGS. 24 and 25).

Figure 25:
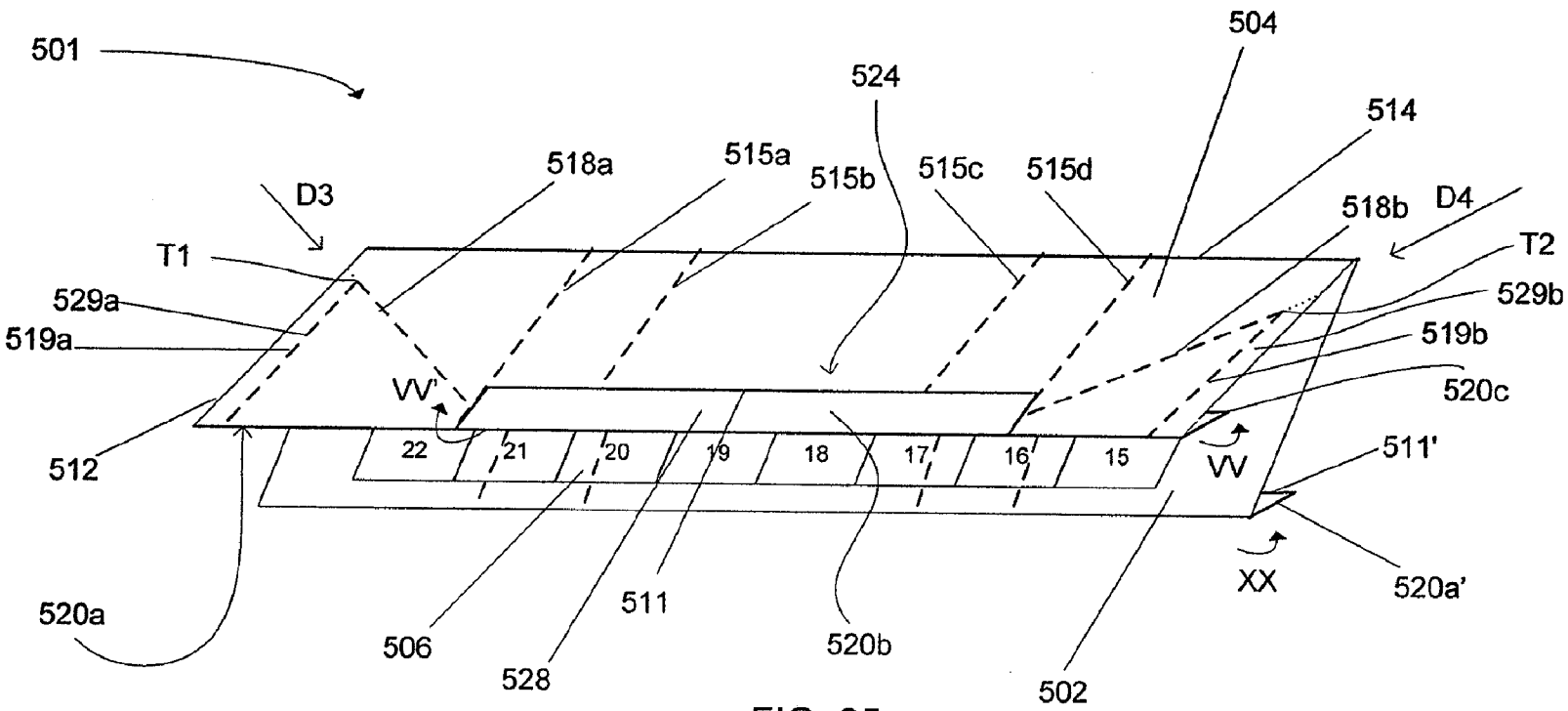
FIG. 25 is a perspective view of the game board of FIG. 23 in a third configuration.

The game board 501 can be moved from the second configuration to the third configuration by folding a portion of the game board 501 along the second and third horizontal fold lines 520, 520' as shown by the arrows VV, VV' and XX in FIG. 25. More particularly, as shown in FIG. 25, the first section 520*a* and the third section 520*c* of the game board 501 are folded about the second horizontal fold line 520 in the direction as shown by arrow VV toward the markings 506 on the first side 502 of the game board 501. Said another way, the first section 520*a* and the third section 520*c* of the game board 501 are folded about the second horizontal fold line 520 such that the longitudinal edge 511 (not shown in FIG. 25) of the first and third sections 520*a*, 520*c* are adjacent the first side 502 of the game board 501. The second section 520*b* of the game board 501 is then folded about the second horizontal fold line 520 in the direction as shown by the arrow VV' such that the first longitudinal edge 511 of the second section 520*b* is adjacent the second side 504 of the game board 501. In this manner, the second section 520*b*, once folded, forms a pocket 528 adjacent the second side 504 of the game board 501 configured to retain an object 556 (not illustrated in FIGS. 25-29). Similarly, a portion of the game board 501 is folded about third horizontal line 520' in a direction indicated by arrow XX such that the second longitudinal edge 511' of the game board 501 is adjacent the second side 504 of the game board 501. Once folded, the portion of the game board 501 forms a pocket 528' adjacent the second side 504 of the game board 501.

When the game board 501 is in the third configuration as shown in FIG. 25, a portion of the game board 501 is configured to be cut (e.g., torn, severed, ripped) from the first and second lateral edges 512, 512' along the first and second diagonal fold lines 518*a*, 518*b*. Specifically, a portion of the first diagonal fold line 518*a* is configured to be cut from the first lateral edge 512 in a third direction D3 to a location T1 on the game board 501 where the first diagonal fold line 518*a* and the first vertical fold line 515*a* intersect. Similarly, a portion of the second diagonal fold line 518*b* is configured to be cut from the second lateral edge 512' in a fourth direction D4 to a location T2 on the game board 501 where the second diagonal fold line 518*b* and the fourth vertical fold line 515*d* intersect (see e.g., FIGS. 25 and 26). The first portion of the first diagonal fold line 518*a* and the portion of the second diagonal fold line 518*b* are illustrated in FIG. 25 by dotted lines.

Figure 26:
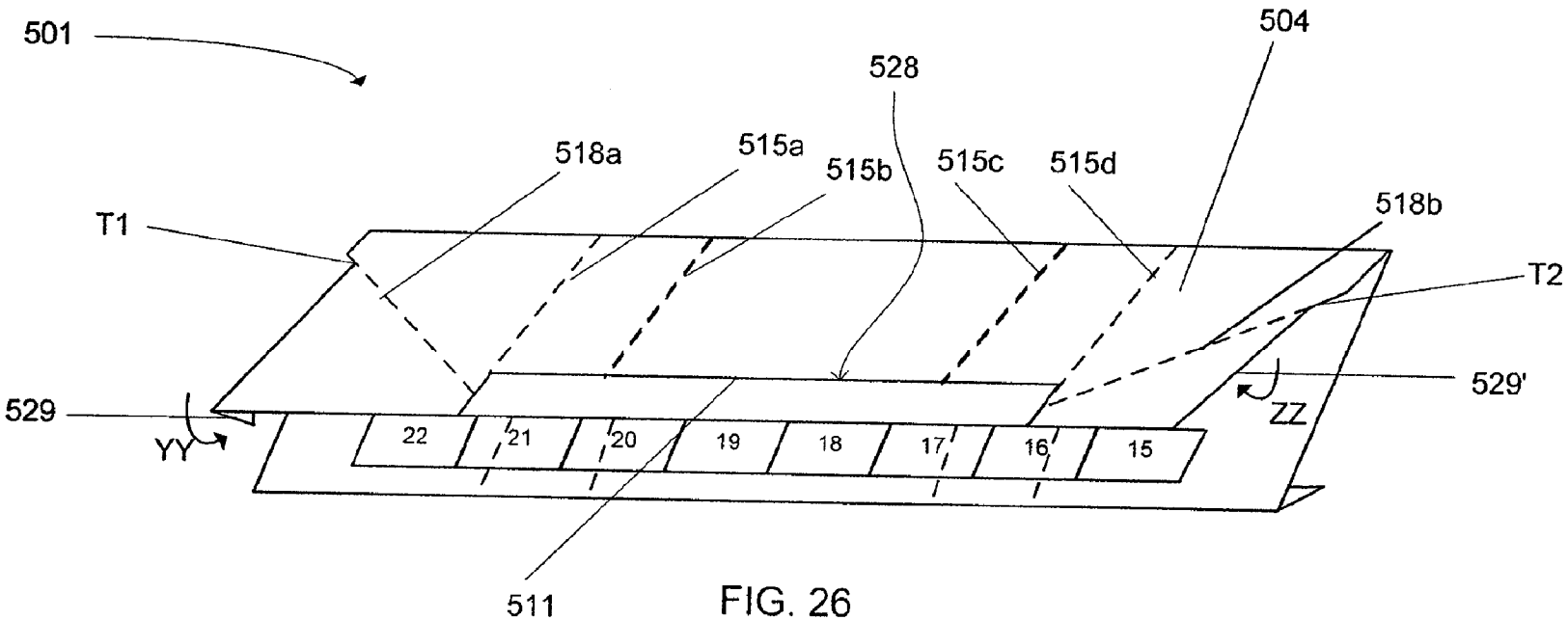
FIGS. 26 and 27 are perspective views of the game board of FIG. 23 in a fourth configuration.
Figure 27:
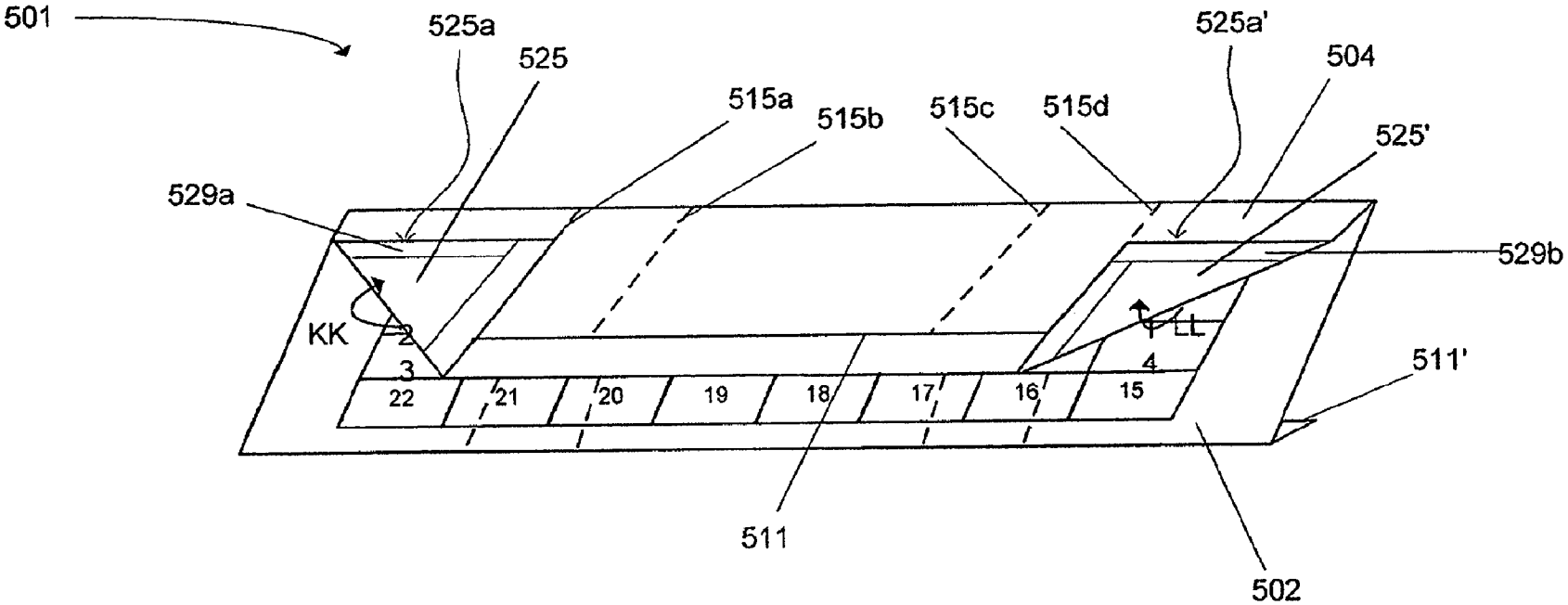

The game board 501 can be moved from the third configuration to the fourth configuration by folding the game board 501 along the fifth and sixth vertical fold lines 519*a*, 519*b* as shown by arrows YY and ZZ in FIG. 26, and by folding the game board 501 along the first and second diagonal fold lines 518*a*, 518*b* as shown by arrows KK and LL in FIG. 27. Specifically, as shown in FIG. 26, a portion 529*a* (see e.g., FIG. 25) of the game board 501 is folded about the fifth vertical fold line 519*a* in a direction YY toward the first side 502 of the game board. Similarly, a portion 529*b* (see e.g., FIG. 25) of the game board 501 is folded about the sixth vertical fold line 519*b* in a direction ZZ toward the first side 502 of the game board 501. Said another way, the portions 529*a*, 529*b* of the game board 501 are folded about the fifth and sixth vertical fold lines 519*a*, 519*b*, respectively, such that the lateral edges 512, 512' of the fifth and sixth vertical fold lines 519*a*, 519*b*, respectively, are adjacent the first side 502 of the game board 501.

Figure 28:
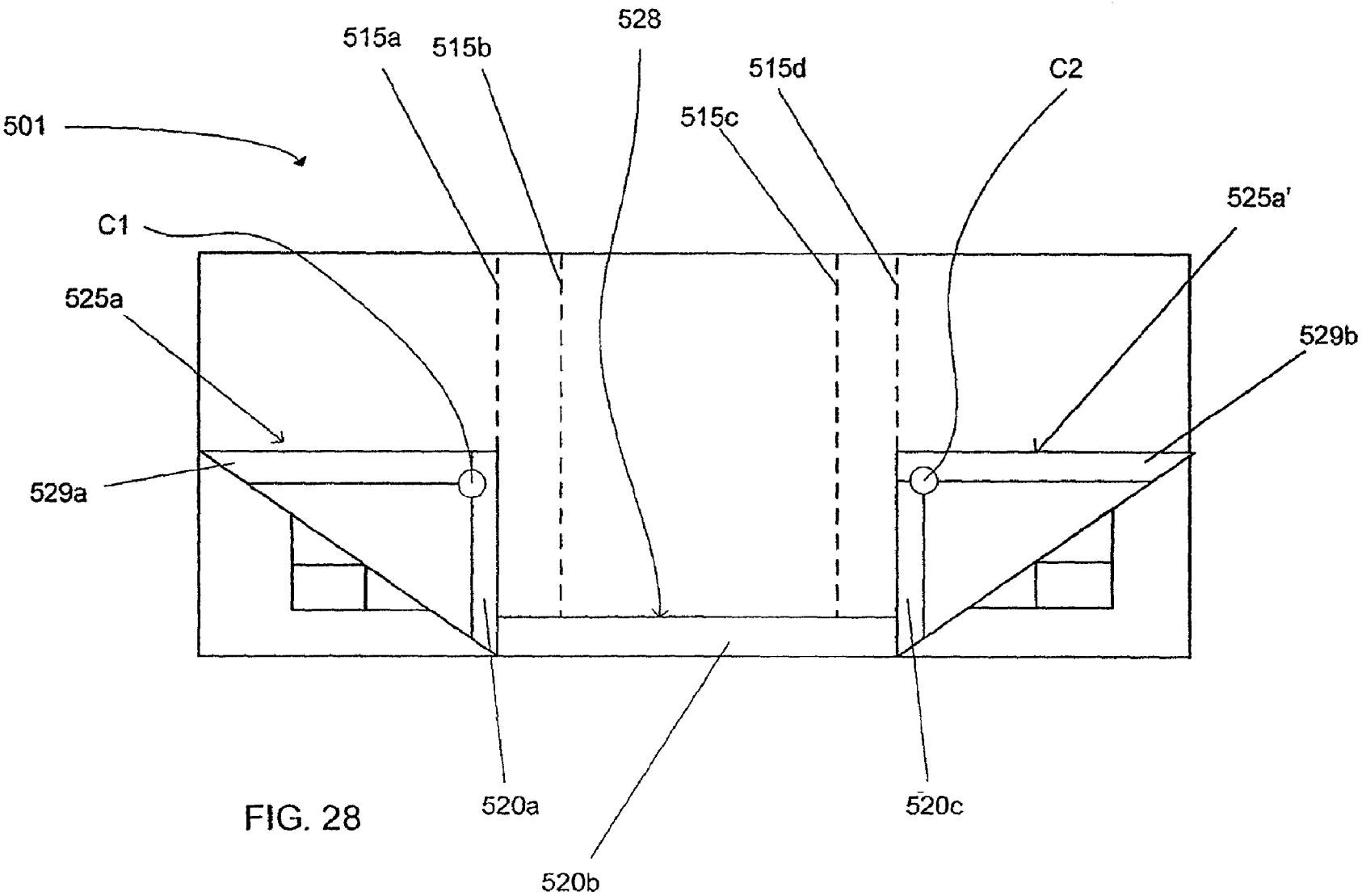
FIG. 28 is a top view of the game board of FIG. 23.

First and second corners 525, 525' of the game board 501 are then folded along first and second diagonal fold lines 518*a*, 518*b* as shown in FIGS. 27 and 28. Specifically, the first corner 525 of the game board 501 is folded about the first diagonal fold line 518*a* in the direction KK toward the second side 504 of the game board 501. Similarly, the second corner 525' of the game board 501 is folded about the second diagonal fold line 518*b* in a direction LL toward the second side 504 of the game board 501. Said another way, the first and second corners 525, 525' are folded about the first and second diagonal fold lines 518*a*, 519*b*, such that the lateral edges 512, 512' and the longitudinal edges 511, 511' of the first and second corners 525, 525' are adjacent the second side 504 of the game board 501. In this manner, once folded, the first corner 525 forms a first corner pocket 525*a* adjacent the second side 504 of the game board 501 configured to retain an object (not shown). Similarly, the second corner 525', once folded, forms a second corner pocket 525*a*' adjacent the second side 504 of the game board 501 configured to retain an object (see e.g., FIG. 30).

The game board 501 can be moved from the fourth configuration to the fifth configuration (i.e., collapsed configuration) by folding the game board 501 along the second and third vertical fold lines 515*b*, 515*c* as shown by arrows FF, FF' in FIGS. 29 and 30. Specifically, the game board 501 is folded about the second vertical fold line 515*b* in a direction shown by arrow FF toward the second corner pocket 525*a*'. Similarly, the game board 501 is folded about the third vertical fold line 515*c* in a direction shown by arrow FF' toward the first corner pocket 525.

By converting folding the game board 501 from its expanded configuration (i.e., first configuration) to its collapsed configuration (i.e. fifth configuration), the game board 501 is converted from a substantially planar surface associated with the game (i.e., first configuration) to a folded configuration (i.e., fifth configuration) configured to contain and/or retain memorabilia (e.g., object 556*a*, 556*b*) within the pockets 528, 528' and first corner pocket 525*a*, and the second corner pocket 525*a*' (see e.g., FIG. 30) More specifically, the game board 501 is converted from a substantially planar surface associated with the game to a display device (e.g., a scrapbook page, a desk display or the like) configured be self supported in an upright position.

When the game board 501 is in the fifth configuration (i.e., collapsed configuration), the first and second corner pockets 525*a*, 525*a*' are configured to be secured to the second side 504 of the game board 501 at locations C1 and C2 (see e.g., FIG. 28) by a coupling member (not shown). The coupling member can be have any suitable configuration for securing first and second corner pockets 525*a*, 525*a*' to the second side 504 of the game board 501. For example, in some embodiments, the coupling member can be a game piece associated with the game and/or game topic. In such embodiments, the game piece can be a pin (e.g., a label pin, a decorative pin, or the like) associated with the game and/or the game topic. For example, in some embodiments, the game topic can be associated with a particular national park and the game pieces can include an insignia or emblem associated with the particular national park.

The game boards shown and described herein can be constructed from any suitable material. In some embodiments, any of the game boards described herein can be constructed from cardboard, cardstock, chipboard, construction paper, polymer-reinforced paper, or the like. In other embodiments, any of the game boards described herein can be constructed from a material having greater flexibility than cardboard. For example, in some embodiments, a game board can be constructed from cloth.

While various embodiments of the invention have been described above, it should be understood that they have been presented by way of example only, and not limitation. Where methods described above indicate certain events occurring in certain order, the ordering of certain events may be modified. Additionally certain events may be performed concurrently in parallel process when possible, as well as performed sequentially. Thus, the breadth and scope of the invention should not be limited by any of the above-described embodiments. While the invention has been particularly shown and described with reference to specific embodiments thereof, it will be understood that various changes in form and details may be made.

For example, although the object 256 is shown as being retained within the pocket 224 without any additional coupling mechanism, in other embodiments, the object can be retained within the pocket by any suitable coupling mechanism. For example, in some embodiments, an object can be retained within a pocket via a game piece. In other embodiments, an object can be retained within a pocket via a pin, a staple, a clip or the like. In yet other embodiments, an object can be retained within a pocket using a self-adhesive portion on the game board.

Although the game board 201 is shown and described such that when the game board 201 is in the sixth configuration, the first surface 202 of the game board 201 is substantially hidden from view, in other embodiments a game board can include openings and/or windows through which a portion of a first surface (e.g., surface 202) can be exposed and/or displayed when the game board is in a folded configuration. In some embodiments, the windows and/or openings can be pre-cut into the game board. In other embodiments, a game board can include a perforated portion configured to be removed to form a window and/or opening in the game board. In this manner, when the game board is in a folded configuration, a portion of the playing surface (e.g., the first surface 202 of the game board 201) and/or the markings (e.g., markings 206) can be exposed and/or displayed.

Although the game board 201 is shown and described above has having fold lines (e.g., fold lines 218, 219, 220) that are spaced approximately equidistance apart, in other embodiments, a game board can include fold lines that are spaced apart by any suitable interval. For example, in some embodiments, a game board can include a central lateral fold region (e.g., analogous to the central lateral fold line 220) that includes two fold lines substantially parallel to each other and spaced apart from each other by a distance of less than ½ inch. Similarly, in some embodiments, a game board can include a lateral fold region (e.g., analogous to the third lateral fold line 218 and the fourth lateral fold line 219) that includes two fold lines substantially parallel to each other and spaced apart from each other by a distance of less than ½ inch. In this manner, the fold regions include "double fold lines," which can increase the thickness of the game board when the game board is in the folded or collapsed configuration. For example, in some embodiments, the fold lines that define the spine of the folded game board can be double fold lines. In this manner, the spine of the folded game board has a width (e.g., the width between the two parallel fold lines). This arrangement can allow for thick objects to placed within the pockets of the folded game board. This arrangement can also provide greater stability when the folded game board is disposed on a flat surface.

Although various embodiments have been described as having particular features and/or combinations of components, other embodiments are possible having a combination of any features and/or components from any of embodiments as discussed above. For example, in some embodiments, a game board can include fold lines configured to be separated, such as certain fold lines described with reference to game board 401 and fold lines configured to form pockets, such as certain fold lines described with reference to game board 201.

Similarly, in some embodiments, a game board can be configured to form pockets of the type shown and described with reference to game board 201, and portions of the pockets can be coupled together via an adhesive, as described above with reference to the game board 101.

The invention claimed is:

1. A game board, comprising:

a first face including a plurality of markings associated with a game;

a second face;

a first fold line;

a second fold line substantially parallel to the first fold line;

a third fold line substantially parallel to the first fold line;

a fourth fold line substantially perpendicular to the first fold line;

the game board having an expanded configuration and a collapsed configuration, the first face of the game board being substantially planar and the first face being opposite the second face when the game board is in the expanded configuration, the game board folded about the first fold line, the second fold line and the third fold line to form a plurality of pages when the game board is in the collapsed configuration, each page from the plurality of pages having a first edge and a second edge, the game board configured to be folded about the fourth fold line to form at least one pocket on each page from the plurality of pages, the at least one pocket on each page from the plurality of pages configured to receive a portion of an object; and a game piece movable about the game board when the game board is in the expanded configuration, the game piece having a connector configured to be coupled to the game board to secure the first edge of each page from the plurality of pages to the first edge of each remaining page from the plurality of pages when the game board is in the collapsed configuration, the second edge of each page from the plurality of pages movable with respect to the first edge of each page from the plurality of pages when the game board is in the collapsed configuration.

2. The game board of claim 1, wherein the game piece is a first game piece, the game board further comprising:

a second game piece movable about the game board when the game board is in the expanded configuration, the first game piece and the second game piece associated with the plurality of markings, the first game piece and the second game piece configured to be coupled to the game board to secure the first edge of each page from the plurality of pages to the first edge of each remaining page from the plurality of pages when the game board is in the collapsed configuration to define, at least in part, a spine about which the plurality of pages can be turned.

3. The game board of claim 1, wherein the game piece is a first game piece, the game board further comprising:

a second game piece movable about the game board, the first game piece and the second game piece associated with the plurality of markings, at least the second game piece configured to retain the game board in the collapsed configuration.

4. The game board of claim 1, wherein:

the at least one pocket is a first pocket; and the game board, in the collapsed configuration, is folded such that each page from the plurality of pages includes the first pocket and a second pocket, the first pocket and the second pocket each configured to receive the portion of the object.

5. The game board of claim 1, further comprising:

at least one self-adhesive portion configured to couple the first edge of each page from the plurality of pages to a first edge of another page from the plurality of pages when the game board is in the collapsed configuration.

6. The game board of claim 1, wherein:

the game board includes at least one perforated portion configured to be separated from the game board to form at least one retention flap; and when the game board is in the collapsed configuration, the at least one retention flap is configured to receive the portion of the object.

7. The game board of claim 1, wherein the plurality of pages includes at least three pages.

8. A game board, comprising:

a first face;

a second face, the game board configured to be folded between an expanded configuration and a collapsed configuration, the first face of the game board including a plurality of markings associated with a game; and an outline portion defined by at least a portion of the plurality of markings and associated with a space for a game piece, the outline portion including a perforated portion configured to be separated from the game board such that a first portion of the outline portion defined by the perforated portion is separate from the game board and a second portion of the outline portion is integral to the game board to form a retention portion, the retention portion configured to removably retain an object against the second face of the game board when the game board is in the collapsed configuration, the game board including a first fold line, a second fold line and a third fold line, the second fold line and the third fold line each substantially parallel to the first fold line, the game board configured to be folded about the first fold line, the second fold line and the third fold to form a plurality of pages when the game board is in the collapsed configuration, each page from the plurality of pages having a first edge and a second edge, each page from the plurality of pages having a pocket; and a plurality of game pieces associated with the plurality of markings, at least one game piece from the plurality of game pieces forming a part of a spine about which the plurality of pages can be turned.

9. The game board of claim 8, wherein:

the first face of the game board defines a substantially planar surface when the game board is in the first configuration; and a portion of the first face of the game board defines a surface offset from the planar surface.

10. The game board of claim 8, wherein the game piece is a pin configured to pierce the game board and retain the game board in the collapsed configuration.

11. The game board of claim 8, further comprising:

at least one self-adhesive portion, the first edge of each page from the plurality of pages coupled to a first edge of another page from the plurality of pages by the at least one self-adhesive portion when the game board is in the collapsed configuration, the second edge of each page from the plurality of pages movable with respect to the first edge of each page from the plurality of pages when the game board is in the collapsed configuration.

12. An apparatus, comprising:

a game board having a first side and a second side, the first side including a plurality of markings associated with a game, the game board having an expanded configuration and a collapsed configuration, the first side of the game board being substantially planar when the game board is in its expanded configuration, the game board configured to be folded to form a plurality of pages when the game board is in its collapsed configuration, each page from the plurality of pages configured to receive a portion of an object; and a plurality of game pieces associated with the plurality of markings, at least one game piece from the plurality of game pieces forming a part of a spine about which the plurality of pages can be turned.

13. The apparatus of 12, wherein the game board is folded such that each page from the plurality of pages includes a pocket configured to receive the portion of the object.

14. The apparatus of 12, wherein:

the game board includes at least one perforated portion configured to be separated from the game board to form at least one retention flap; and when the game board is in the collapsed configuration, the at least one retention flap is configured to receive the portion of the object.

15. The apparatus of 12, wherein the plurality of pages includes at least three pages.

* * * * *